US006174288B1

(12) United States Patent
Samuels

(10) Patent No.: US 6,174,288 B1
(45) Date of Patent: Jan. 16, 2001

(54) DEVICES AND METHODS FOR CONTROLLED MANUAL AND AUTOMATIC FIREARM OPERATION

(76) Inventor: Mark A. Samuels, 4400 Missendell La., Norcross, GA (US) 30092

( * ) Notice: Under 35 U.S.C. 154(b), the term of this patent shall be extended for 0 days.

(21) Appl. No.: 09/373,734

(22) Filed: Aug. 13, 1999

Related U.S. Application Data

(62) Division of application No. 08/970,209, filed on Nov. 14, 1997, now Pat. No. 5,966,859.

(51) Int. Cl.[7] ..... A61B 5/00
(52) U.S. Cl. ..... 600/500; 42/106
(58) Field of Search ..... 600/485, 300, 600/500–503

(56) References Cited

U.S. PATENT DOCUMENTS

| | | | | |
|---|---|---|---|---|
| H218 | | 2/1987 | Marshall et al. . | |
| 3,509,791 | | 5/1970 | Pechamat et al. . | |
| 3,659,494 | | 5/1972 | Philbrick et al. . | |
| 4,020,739 | | 5/1977 | Piotrowski et al. . | |
| 4,411,087 | * | 10/1983 | Aikman | 42/69 A |
| 4,577,962 | | 3/1986 | De Guillenschmidt . | |
| 5,062,232 | | 11/1991 | Eppler . | |
| 5,247,867 | | 9/1993 | Corney . | |
| 5,379,676 | | 1/1995 | Profeta et al. . | |
| 5,448,847 | | 9/1995 | Teetzel . | |
| 5,459,957 | | 10/1995 | Winer . | |
| 5,544,439 | | 8/1996 | Gremble et al. . | |
| 5,596,830 | * | 1/1997 | Morgan | 42/94 |
| 5,636,464 | | 6/1997 | Ciluffo . | |
| 5,675,925 | | 10/1997 | Wurger . | |
| 5,825,283 | * | 10/1998 | Camhi | 340/438 |

* cited by examiner

*Primary Examiner*—Robert L. Nasser
(74) *Attorney, Agent, or Firm*—Fleshner & Kim, LLP

(57) ABSTRACT

A heart beat cycle indicating device for indicating to a firearm operator a defined stage of the heart beat cycle of the firearm operator includes a heart beat cycle monitoring unit for monitoring the heart beat cycle of the firearm operator and a heart beat cycle indicating unit for indicating to the firearm operator a specific stage of the heart beat cycle. A heart beat cycle override unit may be used in combination with the heart beat cycle indicating device to prevent discharge of a firearm during a specified stage of the heart beat cycle of the firearm operator. An automatic firing assembly for automatically firing a firearm when the firearm is aligned with a target comprises a target detection unit in combination with a trigger actuation unit for actuating a firearm trigger. Methods for making a heart beat cycle indicating device and an automatic firing assembly are disclosed, together with methods for operating a firearm in combination with a heart beat cycle indicating device or an automatic firing assembly.

37 Claims, 25 Drawing Sheets

DEVICES AND METHODS FOR CONTROLLED MANUAL AND AUTOMATIC FIREARM OPERATION

This application is a Divisional of application Ser. No. 08/970,209 filed Nov. 14, 1997 now U.S. Pat. No. 5,966, 859.

BACKGROUND OF THE INVENTION

1. Field of the Invention

This invention relates to a device and methods for controlled manual or automatic operation of a firearm. In particular, the invention relates to a device and method for manually firing a firearm during specific periods of the heart beat cycle. The instant invention also relates to a device and method for automatically firing a firearm which has been primed for automatic fire. The invention further relates to a device and method for preventing the manual firing of a weapon during specific parts of the heart beat cycle. The invention still further relates to a device and method for preventing automatic firing of a firearm in response to identification of a friendly target.

2. Background of the Related Art

The heart is a muscular organ which undergoes a series of contractions and relaxations during the heart beat cycle. The heart beat cycle can be briefly summarized as consisting of three stages: diastole, atrial systole, and finally ventricular systole, to be followed once more by diastole. The heart of an individual beats more or less perpetually, at varying rates, throughout life. The heart is located in the left side of the thorax. However, the forces associated with the beating heart and the resultant blood flow throughout the vasculature, are of sufficient magnitude that they are responsible for relatively small yet distinct movement of remote parts of the external body surface. Consequently, involuntary movements associated with the beating heart may interfere with certain intricate tasks requiring extremely finely controlled voluntary movement of the fingers or other body parts.

It is well known in the field of rifle shooting, the decathlon, and other firearm related activities that in order to perform consistently as a marksman it is necessary to fire a firearm at a certain point or period during the heart beat cycle. With extensive training, firearm operators may eventually learn to become aware of and ascertain certain stages of their heart beat cycle, and to coordinate discharge of the firearm with such periods for optimum marksmanship. However, this is at best an imprecise technique. The instant invention provides a heart beat cycle indicating device to clearly indicate to an individual using a firearm, with complete accuracy, a given point in the heart beat cycle of that individual. The firearm operator may then consistently discharge the firearm at the optimum point in the heart beat cycle, thereby achieving the most accurate and consistent results.

Many firearms such as rifles currently in use typically include a sighting device, such as telescopic sights mounted on the firearm, in order to assist the operator of the firearm in aiming the weapon at a target. After lengthy periods of peering through a sighting device of a firearm, a certain amount of fatigue and lack of concentration is inevitably experienced by the operator of the firearm, thereby directly relating to decreased performance, e.g. the probability of hitting the target with any one round from the firearm is decreased.

Furthermore, during combat, assault, and hostage rescue operations, etc., it is often required to engage several targets almost simultaneously or within a very short period of time. Fully automatic assault weapons, such as the H&K MP-5, the Ingram MAC-10, and the Israeli Military Industries UZI, provide a high rate of fire necessary for engaging multiple targets under arduous and/or rapidly changing conditions. (By "fully automatic" in this context denotes a weapon which is capable of firing at a high rate (e.g. 600 rounds per minute) while the trigger continues to be pulled. In contrast, a "semi-automatic" weapon requires a separate pull on the trigger for each round fired.) A high rate of fire consumes a proportionately large amount of ammunition. Since there is a practical limitation on the amount of ammunition that can be carried, it would be useful to have a device for use in conjunction with a weapon for increasing the probability of hitting any given target with each round of ammunition, thereby increasing the likelihood of accomplishing a given task, and/or decreasing the amount of ammunition required to accomplish the task. Such a device for increasing the hit probability for each target would greatly enhance the effectiveness of the weapon with which the device was to be used. A device of the type contemplated for increasing hit probability should be effective against multiple rapidly moving targets which are being engaged from a moving target (e.g. a running soldier).

It would also be advantageous for a device for increasing hit probability of a target by a weapon to provide an indication to an operator of the weapon when a target or potential target is critically aligned with the weapon, and to provide for automatic firing of a weapon having been primed for automatic firing in response to a target being in critical alignment with the weapon. It would also be useful to provide a device enabling automatic firing of a firearm, the firearm having been primed for automatic firing and strategically positioned to fire at a target which may move into critical alignment with the weapon.

According to one embodiment of the instant invention, there is provided devices and methods for the automatic firing of a rifle or other weapon in response to detection of a defined electromagnetic signature (e.g. infrared radiation) emitted from a target. Once such a weapon has been primed for use, it may fire automatically (i.e. in the absence of an operator of the weapon) upon alignment with a target.

U.S. Statutory Invention Registration No. H218, to Marshall et al., discloses a marksmanship training system comprising an infrared detector mounted on a rifle or simulated rifle. A positive indication is provided when the rifle is pointed at an infrared emitting target, e.g. a human. A second detector indicates when the trigger of the rifle is pulled. If a trigger pull is detected at a time when an animal-derived infrared signal is present, the system generates an electronic pulse indicating that a target hit has occurred. The pulse may drive a signaling device to inform the marksman that a target hit has occurred. The device of Marshall et al. relies on manual operation of the rifle trigger, and furthermore the time point at which the trigger is pulled is independent of the alignment of the rifle with the infrared emitting target.

U.S. Pat. No. 3,659,494 to Philbrick, et al. discloses a terrestrial telescope including an image motion stabilization system for eliminating motion of an image being viewed from an unstable support. The telescope may be mounted on a rifle, and the rifle aimed at a target such that the cross hairs of the telescope appear stationary with respect to the target scene. However, the longitudinal axis of the rifle bore is still prone to angular gyration with respect to the target axis. When the rifle bore is aligned with the target the condition may be sensed electronically, at which time a firing device may be actuated. An optional inhibiting circuit is provided, whereby actuation of the firing device is prevented unless a minimum pressure is applied to the trigger. The automatic firing mechanism of Philbrick et al. requires manual operation to aim the weapon at a suitable target and, where the optional inhibiting circuit is employed, to apply a minimum amount of pressure to the trigger. Furthermore, the device of Philbrick et al. will not automatically fire in response to the electromagnetic signature of a target.

U.S. Pat. No. 4,020,739 to Piotrowski et al. discloses a fire control system for increasing the hit probability on a target of a cantilevered adjustably mounted gun. The system includes a flat mirror fixed to the muzzle of the gun. A light source disposed within a gunner's periscope directs a beam of light on a movable mirror only in the absence of gun to periscope positioning errors. The reflected beam from the muzzle mirror impinges on a charge coupled detector matrix array, and provides appropriate compensatory azimuth and elevational error signals which are algebraically added to azimuth and elevational range signals produced by a ballistic computer in response to a range finder sighted on a target. The compensated azimuth and elevational signals are employed to position a movable reticle in the periscope to enable the gunner to aim the gun accurately.

None of the above references teach a device for controlled manual operation of a firearm with respect to the heart beat cycle of the firearm operator, nor a device for automatic discharge of a primed firearm in response to detection of a defined electromagnetic "signature" emitted from an appropriate target.

The above references are incorporated by reference herein where appropriate for teaching additional or alternative details, features, and/or technical background.

SUMMARY OF THE INVENTION

One way to counteract decreased performance over time of a firearm operator is the use of an automatic firing device or mechanism which will automatically fire a preconditioned or primed firearm in response to a target "appearing" in the sighting device, or in response to a target being detected by a detection device as being in critical alignment with the firearm.

Automatic firing of a firearm includes the option of firing a remote firearm accurately at a target without the need for a person to aim or operate the firearm in any way. Alternatively, an operator of a firearm may scan an area using a sighting device and/or a detection device until a target is critically aligned with the firearm, at which time the firearm can fire automatically at the target. Other possibilities exist, for example, a firearm may be oriented with a particular "field of view" of the detection device and the firearm will automatically fire at a time when a target moves into critical alignment with the firearm. Herein, by a target being in critical alignment with the firearm means the target and firearm are aligned such that one or more rounds discharged from the firearm are each expected to score a direct hit on the target.

It would also be useful to be able to prevent or deactivate automatic discharge of a firearm which has been primed to fire in response to detection of a target in the event that the target is determined to be a friendly target. It would also be useful to automatically discharge a firearm in such a way as to compensate for angular motion of the bore of a firearm with respect to a target, wherein the firearm is automatically discharged at a suitable time point in advance of critical alignment of the target with the bore of the firearm.

It may be advantageous for the sake of accuracy to periodically prevent automatic firing according to certain physiological parameters of the firearm operator, e.g. according to his respiratory status (inhalation/exhalation), or during certain periods of the heart beat cycle.

An object, therefore, of the invention is to provide a device which indicates one or more defined periods of the heart beat cycle of an operator of a firearm.

Another object of the invention is to provide a heart beat cycle indicating device for providing to a firearm operator an indication of a defined stage in the heart beat cycle of the firearm operator.

Another object of the invention is to provide a heart beat cycle indicating device in combination with a firearm.

Another object of the invention is to provide a heart beat cycle indicating device for use in combination with a sighting device of a firearm, wherein the heart beat cycle indicating device includes a heart beat cycle indicating unit coupled to the sighting device.

Another object of the invention is to provide a heart beat cycle indicating device in combination with a heart beat cycle override device, wherein the heart beat cycle indicating device provides a heart beat cycle indication to an operator of a firearm of the appropriate time to discharge the firearm, and the heart beat cycle override device prevents discharge of the firearm during inappropriate stages of the heart beat cycle of the firearm operator.

Another object of the invention is to provide an automatic firing assembly for use in combination with a firearm, wherein the automatic firing assembly can cause the firearm to fire automatically when the firearm is aligned with a suitable target.

Another object of the invention is to provide a heart beat cycle indicating device for use in combination with a firearm, and an automatic firing assembly for use in combination with the same firearm.

Another object of the invention is to provide a method for making a heart beat cycle indicating device.

Another object of the invention is to provide a method for making a heart beat cycle indicating device in combination with a heart beat cycle override device.

Another object of the invention is to provide a method for making an automatic firing assembly for automatically firing a firearm when a suitable target is aligned with the firearm.

Another object of the invention is to provide a method for making an automatic firing assembly, for automatically firing a firearm when a target is aligned with the firearm, in combination with a heart beat cycle override device for preventing automatic firing of the firearm during periods of the heart beat cycle of the firearm operator defined as being inappropriate for firing of the firearm.

Another object of the invention is to provide a method for operating a firearm in combination with a heart beat cycle indicating device for providing the firearm operator a heart beat cycle-related indication of an optimum time for firing the firearm.

Another object of the invention is to provide a method for firing a firearm at a target temporally in advance of the target being perfectly aligned with the bore of the firearm in order to compensate for angular movement of the target or angular movement of the firearm.

Another object of the invention is to provide a method for preventing the automatic firing of a firearm when a friendly target is aligned with the firearm.

Another object of the invention is to provide a method for modifying a conventional firearm to enable the modified firearm to discharge automatically in response to critical alignment with a target.

Another object of the invention is to provide a method for identifying a target as a friendly target in a manner which is unlikely to be detected by a non-friendly party.

One advantage of the invention is that it provides a mechanism to inform a firearm operator of the stage of his or her heart beat cycle during operation of a firearm.

Another advantage of the invention is that it provides a mechanism to inform a firearm operator of the stage of his or her heart beat cycle during operation of a firearm, without the need for electrical contact between the firearm operator and the firearm.

Another advantage of the invention is that it allows a firearm operator to discharge a firearm at an optimum stage during his or her heart beat cycle.

Another advantage of the invention is that it can prevent firing of a firearm during an inappropriate stage in the heart beat cycle of a firearm operator.

Another advantage of the invention is that it enables a firearm to be fired automatically in response to a target becoming critically aligned with the firearm.

Another advantage of the invention is that it can prevent a firearm from being fired automatically during inappropriate stages of the heart beat cycle of an operator of the firearm.

One feature of the invention is that it provides a heart beat cycle indicating device including a heart beat cycle monitoring unit and a heart beat cycle indicating unit.

Another feature of the invention is that it provides a heart beat cycle indicating device for use in combination with a firearm, wherein the heart beat cycle indicating device includes an infrared transmitter and an infrared receiver.

Another feature of the invention is that it provides a heart beat cycle indicating device for use in combination with a firearm, wherein the heart beat cycle indicating device includes a heart beat cycle indicating unit, and the heart beat cycle indicating unit is coupled to a sighting device of the firearm.

Another feature of the invention is that it provides an automatic firing assembly for firing a firearm when a target becomes aligned with the firearm, the automatic firing assembly including a target detection unit for detecting a target and a trigger actuation unit coupled to a trigger of the firearm.

Another feature of the invention is that it provides an automatic firing assembly including a trigger priming unit.

Another feature of the invention is that it includes an override device for preventing automatic or manual firing of a firearm during on or more defined stages of the heart beat cycle of a firearm operator.

Another feature of the invention is that it provides an automatic firing assembly capable of identifying a target as friend or foe, and can prevent automatic firing of a firearm at a friendly target.

These and other objects, advantages and features are accomplished by the provision of a heart beat cycle indicating assembly for indicating to a firearm operator a defined stage of the heart beat cycle of the firearm operator, the assembly including: a heart beat cycle monitoring unit, and a heart beat cycle indicating unit coupled to the heart beat cycle monitoring unit, the heart beat cycle monitoring unit transmitting a heart beat cycle-related signal to the heart beat cycle indicating unit, the heart beat cycle indicating unit capable of indicating to the firearm operator a defined stage of the heart beat cycle of the firearm operator.

These and other objects, advantages and features are also accomplished by the provision of a firearm in combination with a heart beat cycle indicating assembly, including: a firearm including a sighting device; a heart beat cycle indicating unit coupled to the sighting device; a heart beat cycle signal transmission unit coupled to the heart beat cycle indicating unit; and a heart beat cycle monitoring unit coupled to the heart beat cycle signal transmission unit.

These and other objects, advantages and features are also accomplished by the provision of a sighting device and heart beat cycle indicating assembly for use with a firearm, including: a heart beat cycle indicating unit coupled to the sighting device; and a heart beat cycle monitoring unit coupled to the heart beat cycle indicating unit.

These and other objects, advantages and features are further accomplished by the provision of a heart beat cycle indicating device for use with a firearm, including: a heart beat cycle monitoring unit; a transmitter unit coupled to the heart beat cycle monitoring unit; a receiver unit for receiving transmissions from the transmitter unit; and a heart beat cycle indicating unit coupled to the receiver unit.

These and other objects, advantages and features are accomplished by the provision of an automatic firing assembly for a firearm, including: a target detection unit and a trigger unit.

These and other objects, advantages and features are accomplished by the provision of an automatic firing assembly for a firearm, including: a target detection unit; a trigger actuation unit coupled to the target detection unit; a trigger coupled to the trigger actuation unit; and a trigger priming unit coupled to the trigger.

These and other objects, advantages and features are accomplished by the provision of an automatic firing assembly for a firearm, including: a target detection unit; a trigger actuation unit coupled to the target detection unit; a trigger coupled to the trigger actuation unit; and a trigger priming unit, wherein the trigger actuation unit is capable of being automatically activated in response to critical alignment of the firearm with a suitable target.

These and other objects, advantages and features are accomplished by the provision of a heart beat cycle override device for use in combination with an automatic firing assembly, including: a heart beat cycle monitoring unit; and an override unit coupled to both the heart beat cycle monitoring unit and the automatic firing assembly.

These and other objects, advantages and features are accomplished by the provision of a method for making a heart beat cycle indicating device, including the steps of: a) providing a heart beat cycle monitoring unit; b) providing a heart beat cycle indicating unit; and c) coupling the heart beat cycle indicating unit to the heart beat cycle monitoring unit.

These and other objects, advantages and features are accomplished by the provision of a method for making a heart beat cycle indicating device in combination with a heart beat cycle override device, including the steps of: a) providing a heart beat cycle monitoring unit; b) providing a hear beat cycle indicating unit; c) coupling the indicating unit to the heart beat cycle monitoring unit to form the heart beat cycle indicating device; d) providing a heart beat cycle override unit; e) coupling the heart beat cycle override unit to the heart beat cycle indicating device; and f) coupling the heart beat cycle override unit to a firearm trigger.

These and other objects, advantages and features are also accomplished by the provision of a method for making an automatic firing assembly for automatically firing a firearm, including the steps of: a) providing a target detection unit; b) providing a trigger actuation unit; and c) coupling the target detection unit to the trigger actuation unit.

These and other objects, advantages and features are accomplished by the provision of a method for making an automatic firing assembly including a heart beat cycle override feature, including the steps of: a) providing an automatic firing assembly; b) providing a heart beat cycle override unit; c) coupling the heart beat cycle override unit to the automatic firing assembly provided in steps a) through e); d) providing a heart beat cycle monitoring unit; and e) coupling the heart beat cycle monitoring unit to the heart beat cycle override unit.

These and other objects, advantages and features are accomplished by the provision of a method for operating a firearm in combination with a heart beat cycle indicating device, including the steps of: a) providing a heart beat cycle indicating device and a firearm, wherein the heart beat cycle indicating device includes a heart beat cycle indicating unit, the heart beat cycle indicating unit capable of providing a heart beat cycle indication to a firearm operator of an appropriate time to discharge the firearm with respect to the heart beat cycle of the firearm operator; b) programming the heart beat cycle indicating device to provide an appropriate heart beat cycle indication to the firearm operator; c) aiming the firearm at a target; and d) while maintaining the aim of the firearm, discharging the firearm in response to the heart beat cycle indication from the heart beat cycle indicating unit.

These and other objects, advantages and features are accomplished by the provision of a method for discharging a firearm equipped with an automatic firing assembly, including the steps of: providing a firearm/automatic firing assembly combination including a trigger priming unit, a trigger, and a target detection unit, the target detection unit capable of detecting a particular spectrum of electromagnetic radiation; priming the firearm/automatic firing assembly; and aiming the firearm/automatic firing assembly at a target or potential target.

These and other objects, advantages and features will become more apparent from the following description of embodiments thereof taken in conjunction with the accompanying drawings.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings wherein.

DETAILED DESCRIPTION OF PREFERRED EMBODIMENTS

Figure 1A:
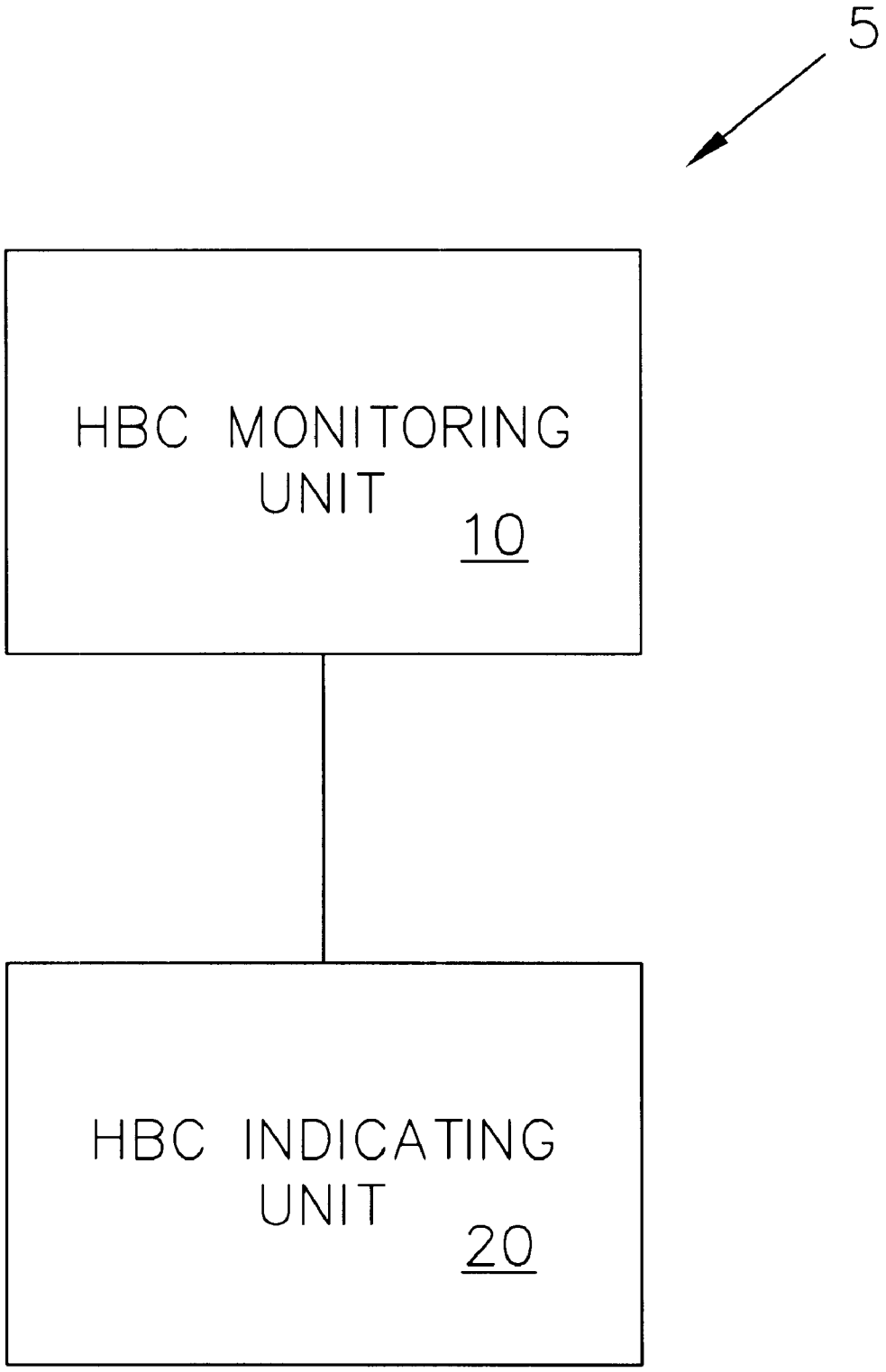
FIG. 1A is a box diagram to schematically represent a heart beat cycle indicating device, according to one embodiment of the invention.

Referring to the drawings, FIGS. 1A, 1B, 2A, and 2B schematically represent a heart beat cycle indicating device or assembly 5/5', according to one embodiment of the invention. Assembly 5/5' includes a heart beat cycle monitoring unit 10 for monitoring the heart beat cycle of an individual who is operating or about to operate a firearm. Heart beat cycle monitoring unit 10 may be attached directly to the body surface of the firearm operator. As an example, heart beat cycle monitoring unit 10 may monitor an individual's heart beat cycle or pulse, by pulse oximetry of arterial blood volume, or by using an electrode component to detect electrical "echoes" of currents emanating from the heart.

A single complete pulsation of the heart of an individual is referred to as a heart beat. The heart beat cycle may be divided into a series of phases as described below.

The Heart Beat Cycle or Heart Cycle

The pumping action of the heart has three main phases for each heart beat: diastole, atrial systole, and ventricular systole. Like other muscular contractions, the contraction of the heart muscle is motivated by electrical impulses therein. Each beat is brought about by electrical waves that emanate from the heart's own pacemaker, the sinoatrial node. The phases of the cycle may be discerned from the tracing of an electrocardiogram.

Diastole

During this resting phase the heart fills with blood. Deoxygenated blood flows into the right side of the heart; at the same time oxygenated blood flows into the left side. In diastole the heart muscle is at rest. Toward the end of this phase of the heart beat cycle an electrical impulse begins to emanate from the sinoatrial node.

Atrial systole

In this second phase the two atria (upper chambers of the heart) contract simultaneously, forcing more blood into the ventricles, which become fully filled. Atrial systole is brought about by the impulse from the sinoatrial node spreading over the atria. This impulse soon reaches another node, the atrioventricular node.

Ventricular systole

The ventricles contract to pump deoxygenated blood into the pulmonary artery and oxygenated blood into the aorta. Ventricular systole is brought about by waves of electrical activity carried from the atrioventricular node to all parts of the ventricles by means of special fibers. When the heart is emptied following contraction of the ventricles, diastole begins once again to complete the cycle.

During ventricular systole oxygenated blood is pumped into the aorta, resulting in a surge in arterial blood volume. Pulse oximetry may be used to monitor the pulse rate of an individual based on the time-variant photoplethysmographic signal, specifically by measuring the time-variant changes in absorbence in the red and infrared wavelengths.

Because the human body is a good conductor of electricity, electrical activity associated with the heart beat cycle can be detected at the body surface. Thus, by applying electrodes to the skin of an individual, his heart beat cycle may be monitored, e.g. by medical professionals. Cardiac rhythm or the heart beat cycle may be recorded via an electrocardiogram (EKG). Electrical activity originating in the heart can be readily detected by electrodes attached to the skin towards the extremities, e.g., the wrists and ankles. For example, a positive electrode on the left wrist opposite a negative electrode on the right wrist registers a positive spike on the EKG during depolarization, revealing how current flows across the heart from right to left.

Because the various stages of the heart beat cycle are associated with characteristic electrical activity, it is possible to determine the stage of the heart beat cycle of an individual by monitoring such electrical activity, as is well known in the art. Thus heart beat cycle monitoring unit 10 may include a plurality of electrodes for attachment to a firearm operator, together with a sensitive ammeter for detecting relatively small electrical currents, emanating from cardiac muscle, and conducted to the body surface of the firearm operator.

FIG. 1A shows a heart beat cycle indicating device 5, including a heart beat cycle monitoring unit 10 coupled to a heart beat cycle indicating unit 20. Heart beat cycle monitoring unit 10 may monitor the heart beat cycle of a firearm operator either via pulse oximetry or via EKG-related electrical signals (FIGS. 1C and 1D, respectively). Heart beat cycle monitoring unit 10 is capable of transferring a heart beat cycle related signal to heart beat cycle indicating unit 20. Heart beat cycle indicating unit 20 is capable of providing an indication to the firearm operator of a defined stage of his/her heart beat cycle, or of any time point related to a defined stage of the heart beat cycle. Heart beat cycle indicating unit 20 may be preprogrammed to provide a clear and unambiguous indication to a firearm operator of an optimum time to discharge the firearm. The indication provided to the firearm operator to discharge the firearm will normally be temporally related to a defined stage in the heart beat cycle of the firearm operator as monitored by heart beat cycle monitoring unit 10. A temporal relationship between an indication to discharge the firearm and a defined stage in the heart beat cycle of the firearm operator may be determined according to a number of variables related to the physiological status of the firearm operator, the firearm operator's reaction speed, and other parameters.

Heart beat cycle indicating unit 20 may include a video display unit, an illumination source or device, and/or an audio device or a source of sound. Heart beat cycle indicating unit 20 is capable of providing a clear indication (visual, audible, etc.) to the firearm operator to discharge the firearm immediately upon receipt of such an indication from heart beat cycle indicating unit 20.

According to one embodiment of the invention, heart beat cycle indicating device 5 may include a sighting device 25 (FIG. 1C) for use with, or attachment to, a firearm. Heart beat cycle indicating unit 20 may be coupled to such a sighting device 25 of a firearm.

Heart beat cycle indicating unit 20 may provide an indication to the firearm operator which may be visual and/or audible. In the case where heart beat cycle indicating unit 20 provides a visual indication, heart beat cycle indicating unit 20 may include a display unit (not shown) for illumination or for displaying some form of image. A heart beat cycle indicating unit 20 including a display unit may be attached to a firearm as a separate component, or alternatively may be integral with sighting device 25 of a firearm (FIG. 1C).

A visual indication provided by heart beat cycle indicating unit 20 could be provided as various forms of illumination, for example in the form of an initially small spot which expands to fill an entire circle at the optimum time for firearm discharge. The reverse of this could be done as well. Alternatively, a visual indication provided by heart beat cycle indicating unit 20 could employ a VU meter which gradually increases until it reaches a full scale reading coincident with the optimum time for firearm discharge. The reverse of this could be done as well. Thus, according to a preferred embodiment, heart beat cycle indicating unit 20 provides a visual indication to the firearm operator of the optimum time for firearm discharge, wherein a period of time prior to such optimum time can be displayed by heart beat cycle indicating unit 20 and monitored by the firearm operator. Furthermore, according to a preferred embodiment of the invention, heart beat cycle indicating unit 20 may provide a visual indication to the firearm operator of the optimum time to discharge a firearm, wherein the visual indication appears within sighting device 25 (FIG. 1C) of the firearm. Alternatively, a visual indication provided by heart beat cycle indicating unit 20 may appear outside or separately from sighting device 25 (FIG. 1C) of a firearm.

Heart beat cycle indicating unit 20 may also provide an audible indication to the firearm operator. An audible indication provided by heart beat cycle indicating unit 20 could be provided, for example, as a given number of beeps in the form of a series of beeps having either constant or changing periodicity; or the end of a single continuous beep could indicate to the firearm operator the optimum time for discharge of the firearm. Under certain circumstances, e.g. target practice or marksmanship training, an ambient audible signal may be provided. Under circumstances in which audible signals could be detrimental, e.g. deer hunting, an ambient audible signal is to be avoided, in which case an audible signal may be provided, for example via a head set, which is only audible to the firearm operator. Many other indicating means are known in the art and/or are within the spirit and scope of the invention.

Figure 1B:
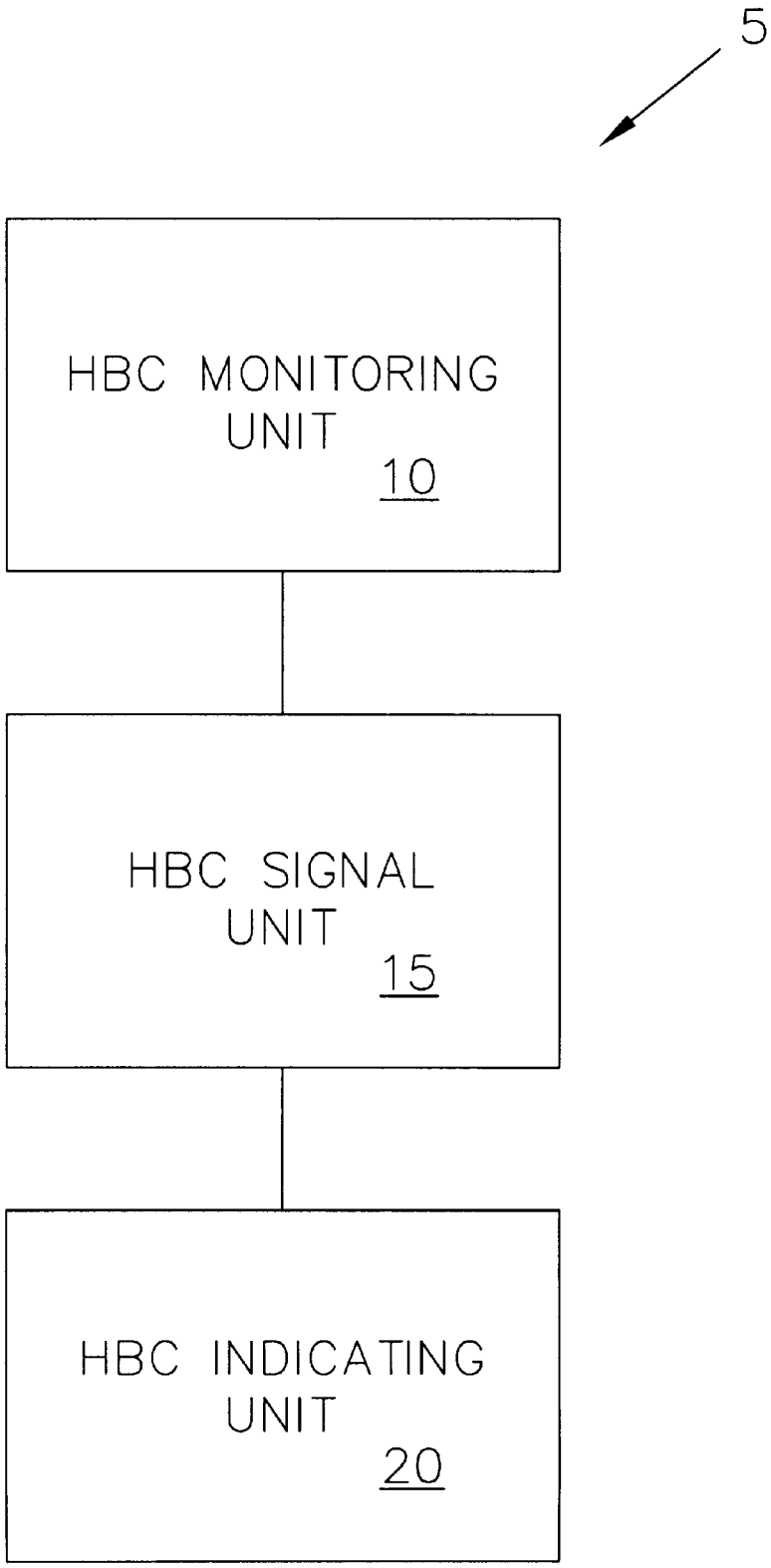
FIG. 1B is a box diagram to schematically represent a heart beat cycle indicating device, according to one embodiment of the invention.
Figure 1C:
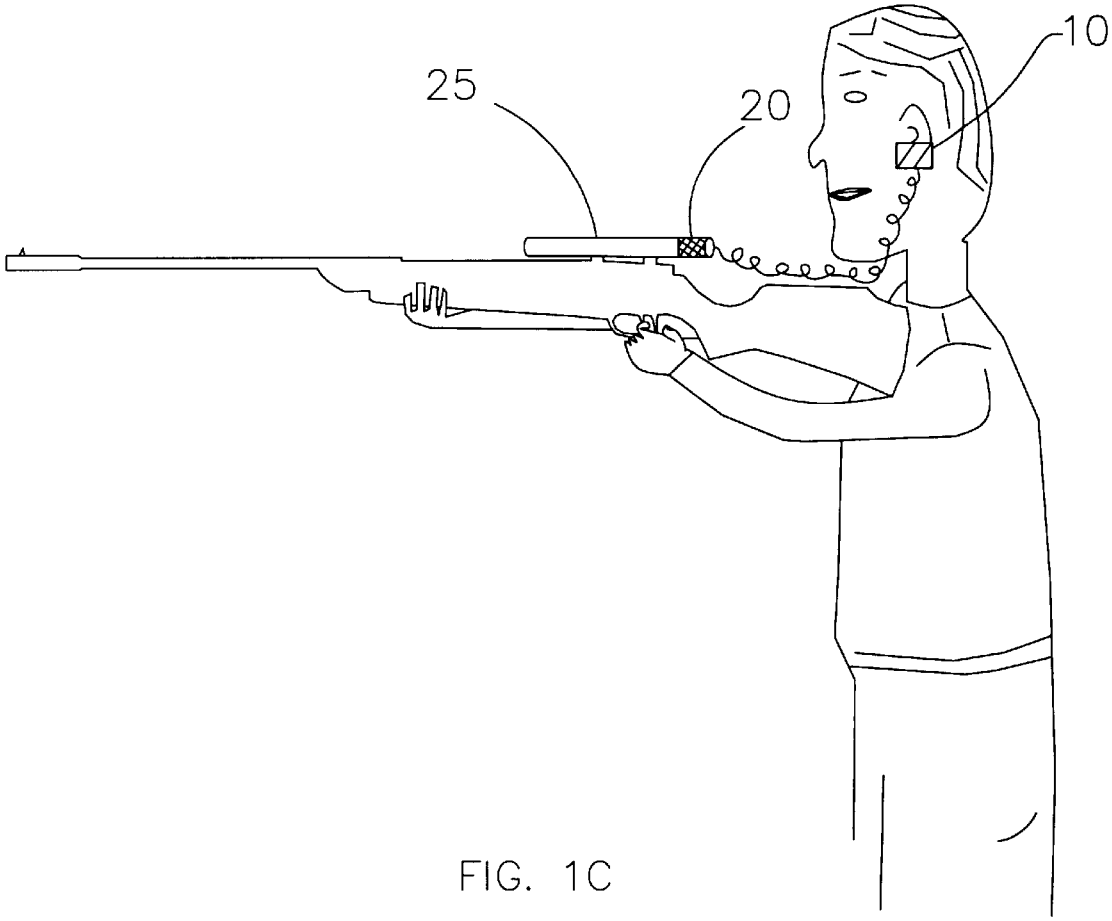
FIGS. 1C and 1D each show a heart beat cycle indicating device in relation to a firearm operator, according to two different embodiments of the invention.
Figure 1D:
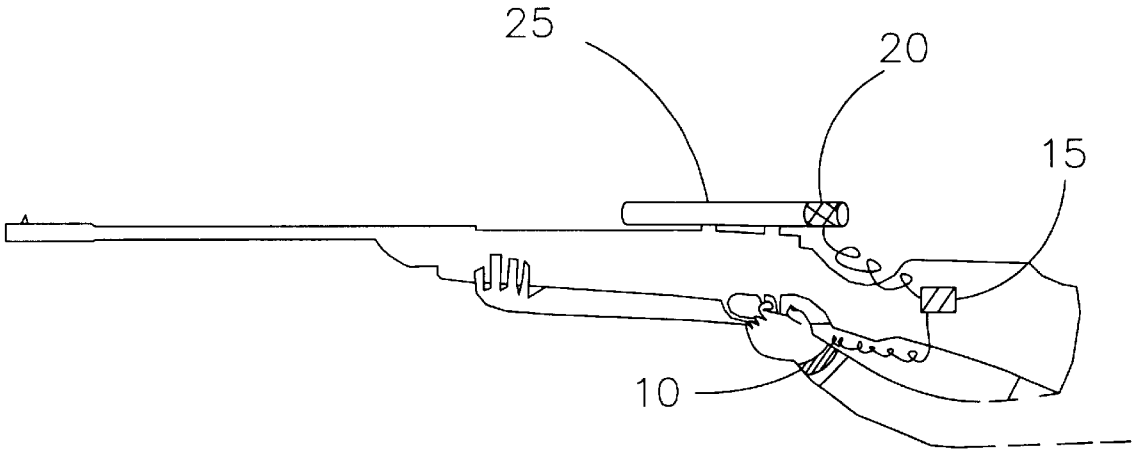

FIG. 1B shows a heart beat cycle indicating device 5, including a heart beat cycle monitoring unit 10 coupled to a heart beat cycle signal transmission unit or heart beat cycle signal unit 15, which in turn is coupled to a heart beat cycle indicating unit 20. Heart beat cycle signal transmission unit 15 is capable of receiving a heart beat cycle-related signal from heart beat cycle monitoring unit 10 and of transferring a heart beat cycle-related signal to heart beat cycle indicating unit 20.

Components of heart beat cycle indicating device 5, including heart beat cycle monitoring unit 10, may be programmed such that heart beat cycle-related signals are input to heart beat cycle indicating unit 20 only at one or more specified or defined stages during the heart beat cycle of the firearm operator. Thus, heart beat cycle monitoring unit 10 or heart beat cycle signal transmission unit 15 may be programmed to provide input to heart beat cycle indicating unit 20, for example, at the beginning of diastole, at x milliseconds prior to the beginning of diastole, or at y milliseconds after the beginning of diastole. In this way, heart beat cycle indicating unit 20 can provide an appropriate indication to the firearm operator to discharge the firearm, and the firearm operator can discharge the firearm in response to the indication at the optimum stage during the heart beat cycle of the firearm operator. Factors such as the reaction time of the firearm operator may be taken into consideration during programming of one or more components of heart beat cycle indicating device 5.

FIG. 1C shows a heart beat cycle indicating device 5 in relation to a firearm operator, in which heart beat cycle monitoring unit 10 is attached to the ear lobe of the firearm operator. It is to be understood that heart beat cycle monitoring unit 10 may also be attached to other body parts of the firearm operator. According to a preferred embodiment of the invention, heart beat cycle monitoring unit 10 may be coupled directly to heart beat cycle indicating unit 20 (FIG. 1A). Alternatively, according to another embodiment of the invention, heart beat cycle monitoring unit 10 may be coupled to heart beat cycle signal transmission unit 15 (not shown in FIG. 1C), which in turn is coupled to heart beat cycle indicating unit 20 (FIG. 1B). Heart beat cycle monitoring unit 10 and heart beat cycle signal transmission unit 15 (when included) are each capable of transmitting a heart beat cycle-related signal corresponding to a defined stage in the heart beat cycle of the firearm operator to heart beat cycle indicating unit 20. In response to such a heart beat cycle-related signal, heart beat cycle indicating unit 20 provides an indication to the firearm operator of an appropriate time at which to discharge the firearm.

FIG. 1D shows a heart beat cycle indicating device 5 in relation to a firearm operator, in which heart beat cycle monitoring unit 10 is attached to the wrist of the firearm operator. It is to be understood that heart beat cycle monitoring unit 10 may also be attached to other body parts of the firearm operator. Heart beat cycle monitoring unit 10 may be coupled directly to heart beat cycle indicating unit 20 (FIG. 1A). Alternatively, heart beat cycle monitoring unit 10 may be coupled to heart beat cycle signal transmission unit 15, which in turn is coupled to heart beat cycle indicating unit 20 (FIG. 1B). Heart beat cycle monitoring unit 10 and heart beat cycle signal transmission unit 15 are each capable of transmitting a heart beat cycle-related signal corresponding to a defined stage in the heart beat cycle of the firearm operator to heart beat cycle indicating unit 20. In response to such a heart beat cycle-related signal, heart beat cycle indicating unit 20 provides an indication to the firearm operator to discharge the firearm.

Heart beat cycle signal transmission unit 15 (when included) may be conveniently mounted to the firearm, for example on the stock portion of the firearm. Heart beat cycle indicating unit 20 may also be conveniently mounted to the firearm, for example adjacent to sighting device 25 of the firearm.

According to one embodiment of the invention, heart beat cycle indicating unit 20 may be integral with sighting device 25. Heart beat cycle monitoring unit 10, heart beat cycle signal transmission unit 15 and heart beat cycle indicating unit 20 may be connected quickly and easily by plug-in or clip connectors, or by other quick-connect/quick release mechanisms well known in the art. Also, heart beat cycle monitoring unit 10, heart beat cycle signal transmission unit 15 and heart beat cycle indicating unit 20 may be coupled by spiral ("telephone style") insulated wire or cable to allow for movement of the various components relative to each other without causing inadvertent disconnection or uncoupling.

Figure 2A:
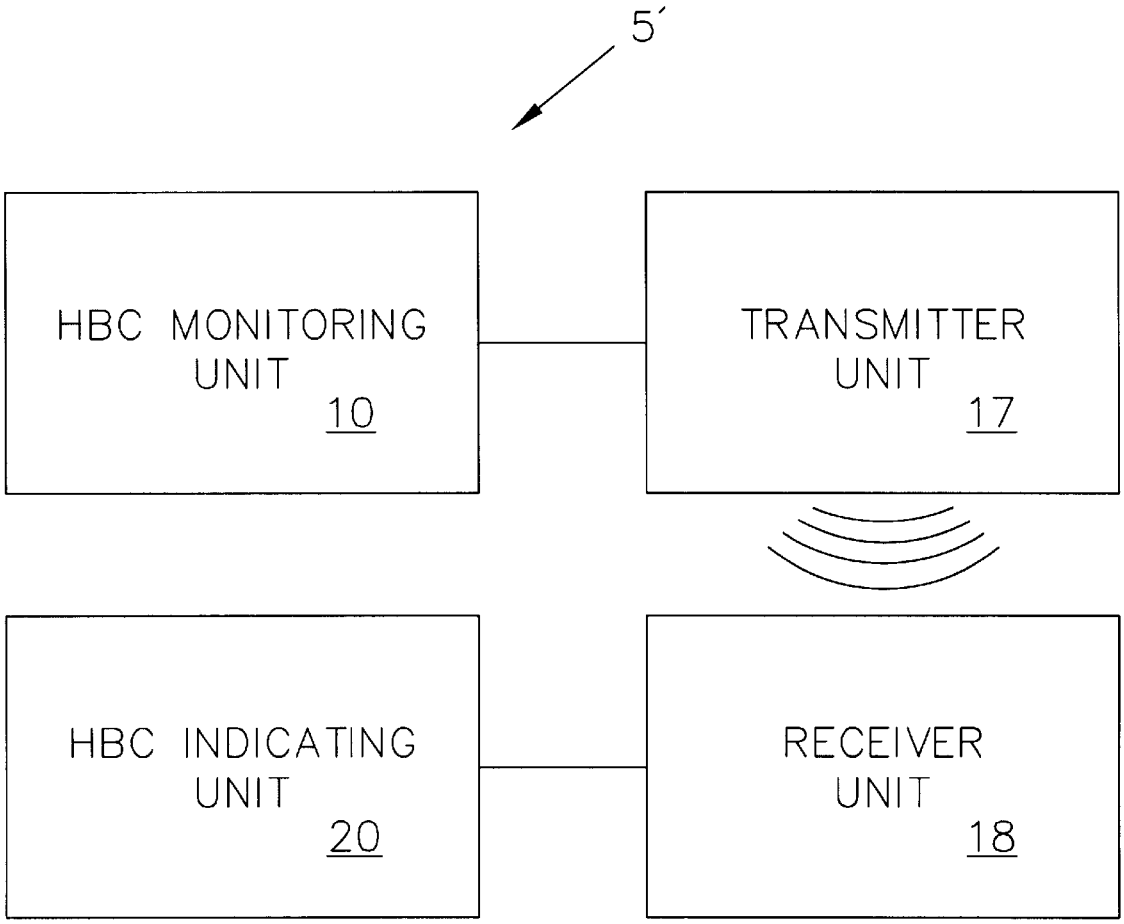
FIGS. 2A and 2B each show a box diagram to schematically represent a heart beat cycle indicating device, according to other embodiments of the invention.

Heart beat cycle indicating device 5' of FIG. 2A includes heart beat cycle monitoring unit 10 which is coupled to a transmitter unit 17. Heart beat cycle monitoring unit 10 is capable of transferring a heart beat cycle-related signal to transmitter unit 17. Transmitter unit 17 transmits electromagnetic radiation in response to input from heart beat cycle monitoring unit 10 regarding the heart beat cycle of the firearm operator. According to a preferred embodiment, transmitter unit 17 is an infrared transmitter.

A receiver unit 18 receives electromagnetic radiation from transmitter unit 17. Heart beat cycle indicating unit 20 is coupled to receiver unit 18 and provides a heart beat cycle-related indication to the firearm operator of the optimum time to discharge the firearm.

Figure 2B:
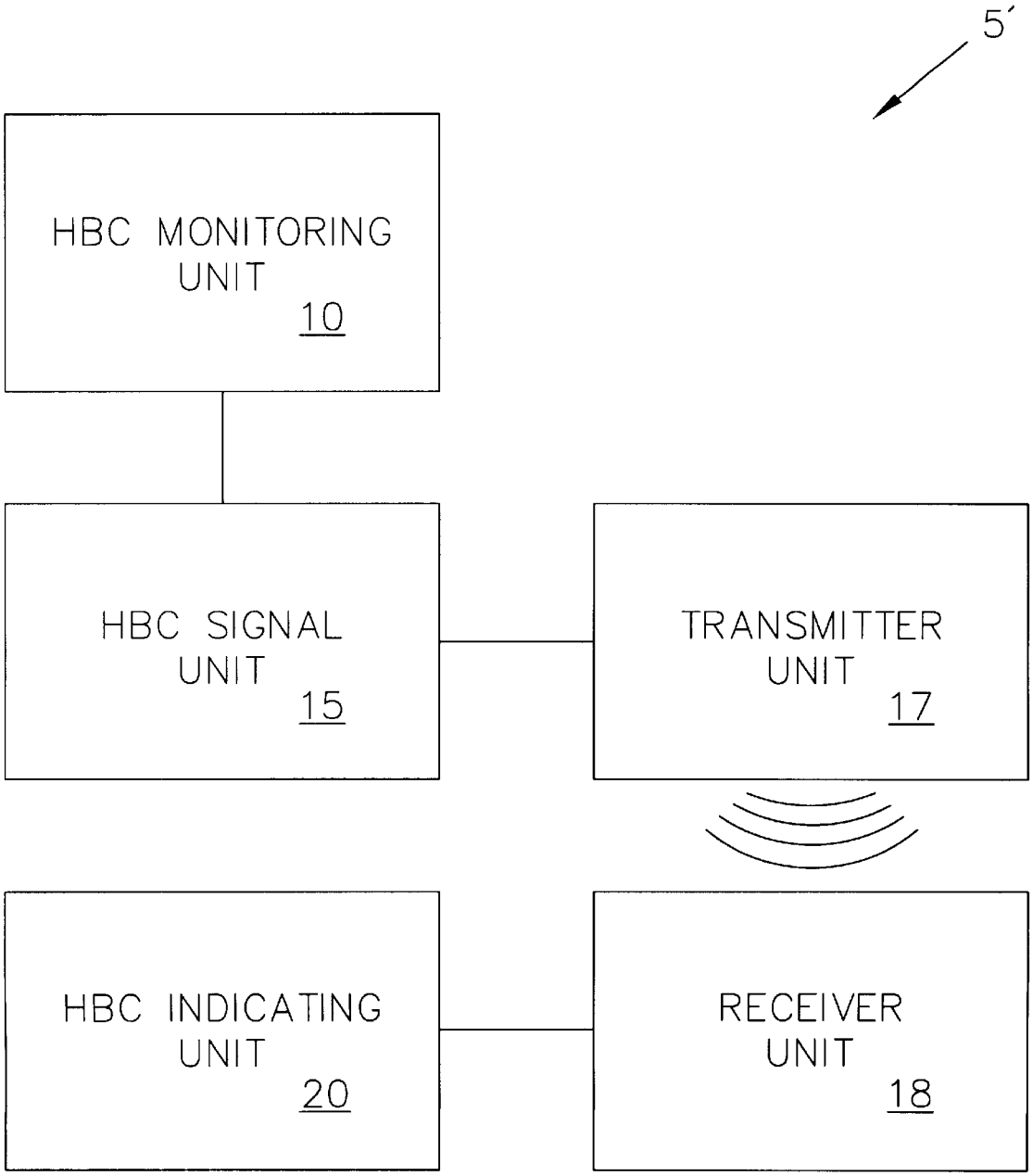

FIG. 2B is a box diagram to schematically represent a heart beat cycle indicating device 5, according to another embodiment of the invention. Heart beat cycle monitoring unit 10 is coupled to heart beat cycle signal transmission unit 15, which in turn is coupled to a heart beat cycle indicating unit 20. Heart beat cycle signal transmission unit 15 is capable of receiving a heart beat cycle-related signal from heart beat cycle monitoring unit 10 and of transmitting a heart beat cycle-related signal to transmitter unit 17, the heart beat cycle-related signal corresponding to a defined stage in the heart beat cycle of the firearm operator. Transmitter unit 17 transmits electromagnetic radiation in response to input from heart beat cycle monitoring unit 10/heart beat cycle signal unit 15 regarding the heart beat cycle of the firearm operator. According to a preferred embodiment, transmitter unit 17 is an infrared transmitter.

A receiver unit 18 receives electromagnetic radiation from transmitter unit 17. Heart beat cycle indicating unit 20 is coupled to receiver unit 18 and provides a heart beat cycle-related indication to the firearm operator of the optimum time to discharge the firearm. Heart beat cycle indicating unit 20 is capable of providing an indication to the firearm operator of a defined stage of the heart beat cycle, or of any time point related to a defined stage of the heart beat cycle. Heart beat cycle indicating unit 20 may include a display unit, a source of illumination, and\or a source of sound (not shown), as described hereinabove with reference to FIG. 1A. An indication provided by heart beat cycle indicating unit 20 of device 5' may be a visual indication or an audible indication, as described hereinabove for heart beat cycle indicating device 5 with reference to FIG. 1A.

Figure 2C:
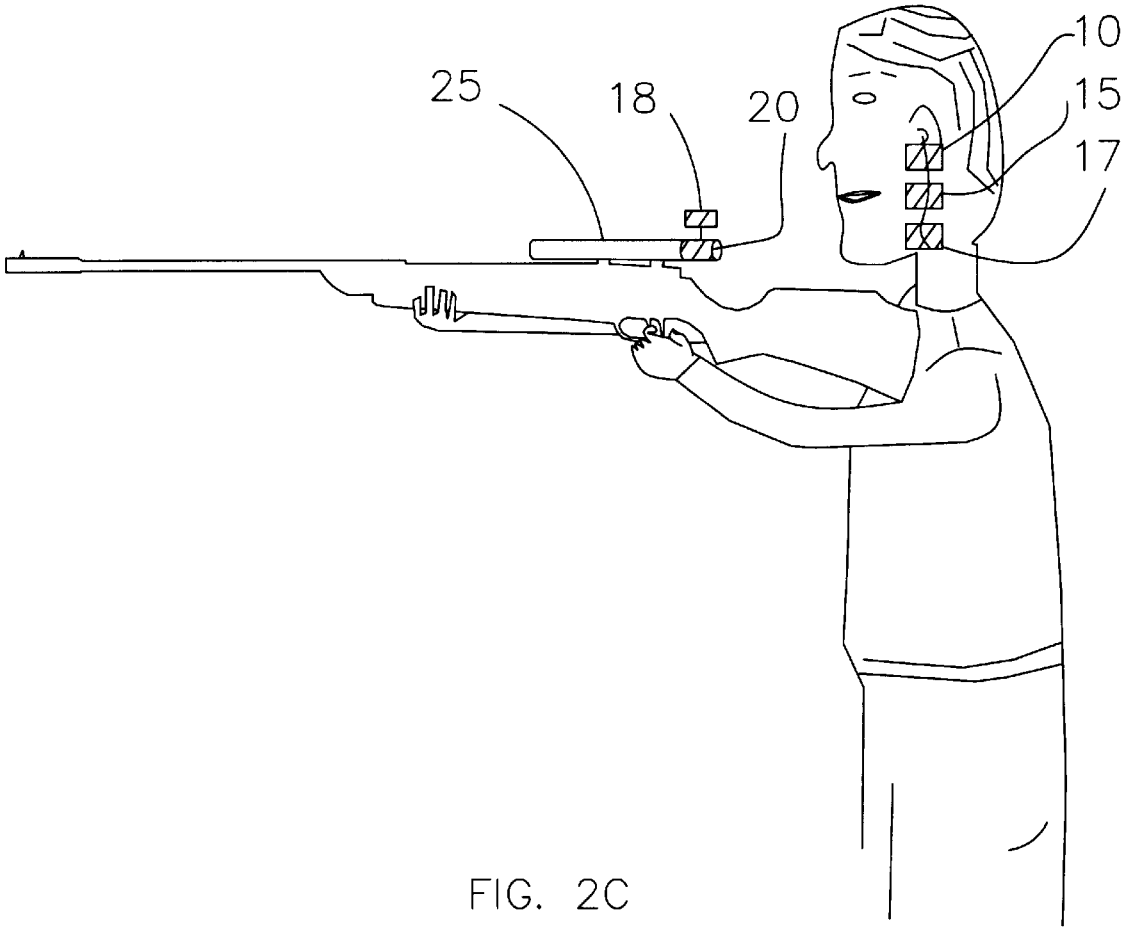
FIGS. 2C and 2D each show a heart beat cycle indicating device in relation to a firearm operator, according to two different embodiments of the invention.

FIG. 2C shows a heart beat cycle indicating device 5' in relation to a firearm operator, in which heart beat cycle monitoring unit 10 is attached to the ear lobe of the firearm operator. It is to be understood that heart beat cycle monitoring unit 10 may also be attached to other body parts of the firearm operator. Heart beat cycle monitoring unit 10 may include a pulse oximeter, for example, a pulse oximeter similar to the Onyx pulse oximeter (Nonin Medical, Inc., Plymouth, Minn.). FIG. 2C shows heart beat cycle monitoring unit 10 as being coupled to heart beat cycle signal transmission unit 15, which in turn is coupled to a transmitter unit 17. However, it is to be understood that heart beat cycle monitoring unit 10 may be coupled directly to transmitter unit 17, and that heart beat cycle signal unit 15 may be omitted. Heart beat cycle monitoring unit 10, heart beat cycle signal transmission unit 15, transmitter unit 17, as well as other components of the invention are depicted in the drawings as being relatively large for illustrative purposes. However, in actuality such components may be miniaturized so as to be relatively inconspicuous and of relatively little weight.

Heart beat cycle monitoring unit 10, and heart beat cycle signal transmission unit 15 (when included), are each capable of transferring a heart beat cycle signal corresponding to a defined stage in the heart beat cycle of the firearm operator to transmitter unit 17. In response to such as a heart beat cycle-related signal, transmitter unit 17 may transmit electromagnetic radiation to a receiver unit 18. Receiver unit 18 is capable of receiving electromagnetic radiation and is coupled to heart beat cycle indicating unit 20. Receiver unit 18 may be mounted on sighting device 25 of the firearm or at other suitable locations. Preferably receiver unit 18 and transmitter unit 17 are positioned so as to provide a "line of sight" therebetween in order to prevent interference during infrared or other electromagnetic radiation transmission between transmitter unit 17 and receiver unit 18. Heart beat cycle indicating unit 20 may be conveniently mounted to the firearm, for example adjacent to the sighting device 25 of the firearm. According to one embodiment of heart beat cycle indicating device 5', heart beat cycle indicating unit 20 may be integral with sighting device 25.

Figure 2D:
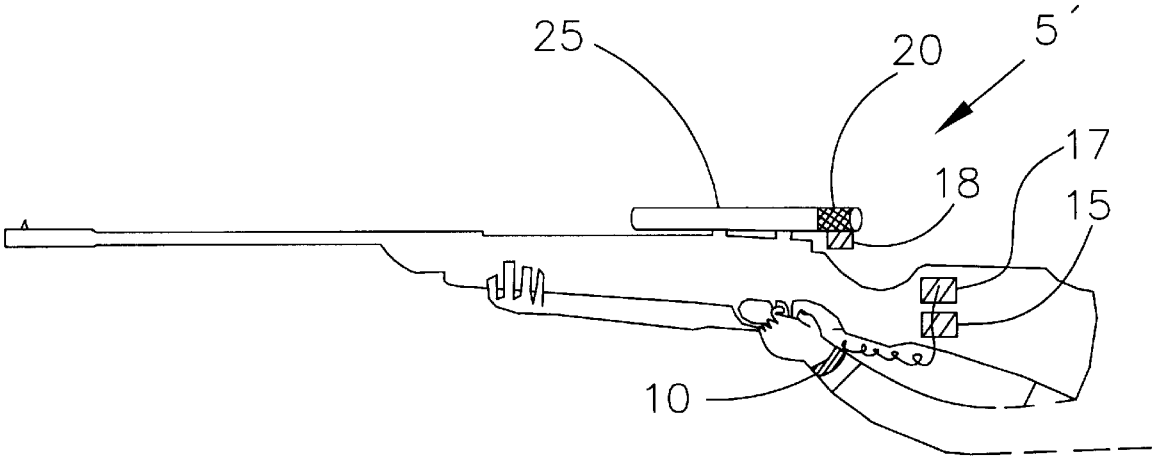

FIG. 2D shows a heart beat cycle indicating device 5' in relation to a firearm operator, in which heart beat cycle monitoring unit 10 is attached to the wrist of the firearm operator. Heart beat cycle monitoring unit 10 may be an EKG-sensitive device including one or more electrodes. It is to be understood that heart beat cycle monitoring unit 10 may also be attached to other body parts of the firearm operator. FIG. 2D shows heart beat cycle monitoring unit 10 as being coupled to heart beat cycle signal transmission unit 15, which in turn is coupled to transmitter unit 17. However, according to a currently preferred embodiment of the invention, heart beat cycle monitoring unit 10 may be coupled directly to transmitter unit 17, and heart beat cycle signal unit 15 may be omitted. Heart beat cycle monitoring unit 10, and heart beat cycle signal transmission unit 15 (when included), are each capable of transmitting a heart beat cycle-related signal corresponding to a defined stage in the heart beat cycle of the firearm operator to transmitter unit 17. In response to such a heart beat cycle-related signal, transmitter unit 17 may transmit electromagnetic radiation to a receiver unit 18. Receiver unit 18 receives electromagnetic radiation and is coupled to heart beat cycle indicating unit 20. Heart beat cycle signal transmission unit 15 and transmitter unit 17 may be conveniently mounted, for example, on the stock portion of a firearm. Alternatively, heart beat cycle signal transmission unit 15 and transmitter unit 17 may be attached on or about the firearm operator, for example on the lower forearm of the firearm operator.

Receiver unit 18 may be mounted on sighting device 25 of a firearm or at other suitable locations. Preferably, receiver unit 18 and transmitter unit 17 are positioned so as to provide a "line of sight" there between in order to prevent interference during infrared or other electromagnetic radiation transmission between transmitter unit 17 and receiver unit 18.

Figure 3:
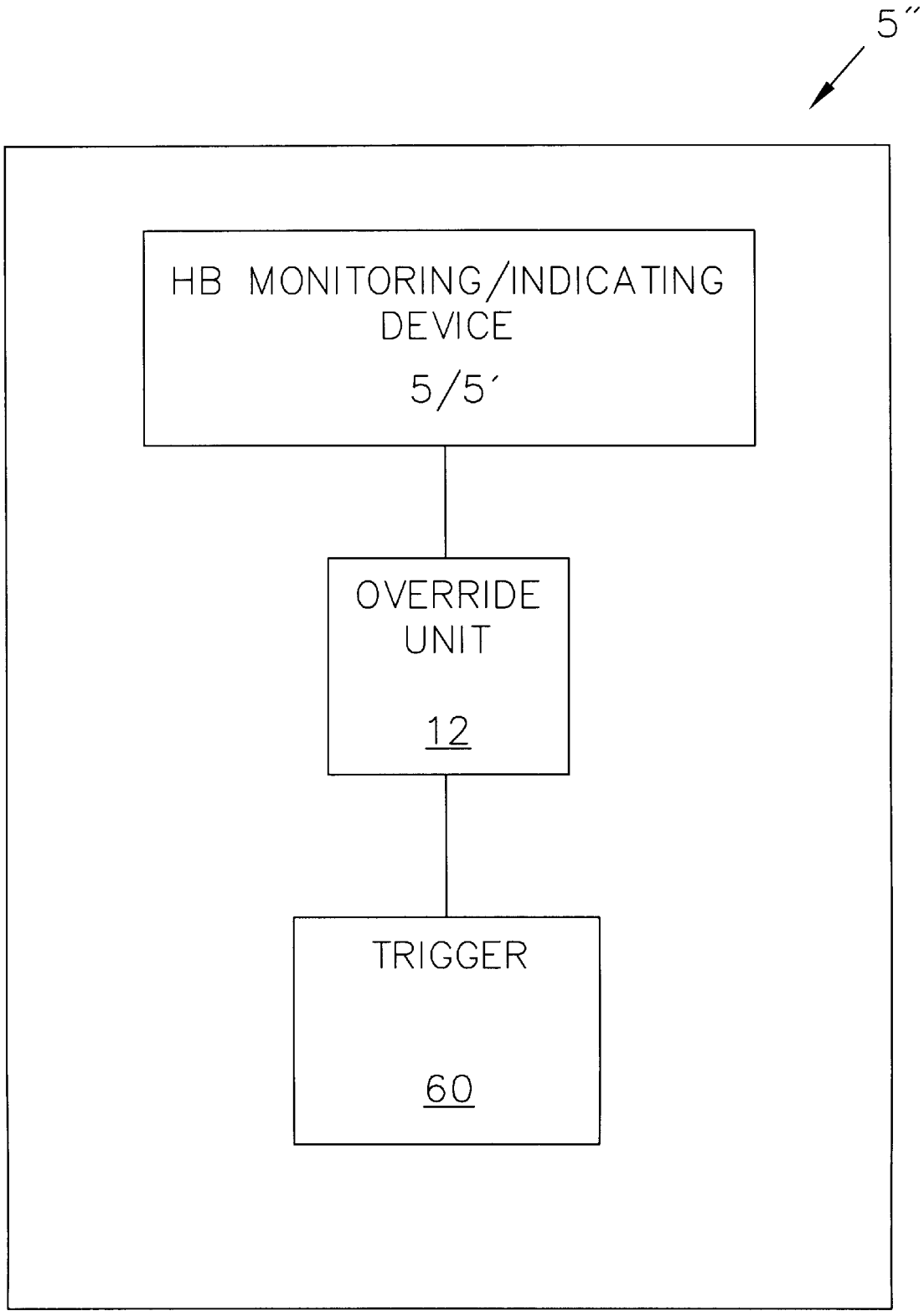
FIG. 3 is a box diagram to schematically show a heart beat cycle indicating device including a heart beat cycle override unit, according to one embodiment of the invention.

FIG. 3 is a box diagram of a heart beat cycle indicating device 5" according to another embodiment of the invention, and shows how a heart beat cycle override unit may be configured with a trigger of a firearm and with a heart beat cycle indicating device 5/5' (FIGS. 1A–1D and 2A–2D). A heart beat cycle override unit 12 may be configured with heart beat cycle indicating device 5/5' and trigger 60, of a firearm, according to FIG. 3, to receive a heart beat cycle-related signal from the heart beat cycle indicating device and to prevent manual operation (firing) of a firearm by a firearm operator during one or more specified periods of the firearm operator's heart beat cycle. In this way, firing of a firearm by a firearm operator may be prevented during inappropriate stages during the heart beat cycle of the firearm operator, for example, during periods when involuntary movement associated with the heart beat cycle are most likely to interfere with optimal firearm operator performance.

According to one embodiment of the invention, override unit 12 may be coupled to heart beat cycle indicating unit 20 (FIGS. 1A–2D) of heart beat cycle indicating device 5/5'. According to another embodiment of the invention, override unit 12 may be coupled to heart beat cycle signal transmission unit 15 (FIGS. 1B, 2B) of heart beat cycle indicating device 5/5'. Override unit 12 may also be coupled directly to trigger 60 to deactivate trigger 60 at specified stages or periods during the heart beat cycle of the firearm operator. Alternatively, according to another embodiment of the invention, override unit 12 may be coupled to a trigger deactivation unit (not shown), which in turn may be coupled to trigger 60 to deactivate trigger 60 at specified stages or periods during the heart beat cycle of the firearm operator. As an example, override unit 12 and/or a trigger deactivation unit may function alone or in combination to transiently deactivate trigger 60 by effectively locking trigger 60 in place and preventing trigger 60 from being moved in the normal manner. During periods when trigger 60 is deactivated the firearm operator cannot discharge the firearm by pulling trigger 60 in the usual way with the usual amount of finger pressure. However, provisions may be made for the firearm operator to negate the effects of override unit 12 should he opt to do so, for example, by exerting additional pressure on trigger 60.

Components of heart beat cycle indicating device 5/5' may be programmed to actuate override unit 12 at one or more pre-defined stages during the heart beat cycle of the firearm operator. For example, heart beat cycle indicating unit 20 may be programmed such that trigger 60 is deactivated by trigger deactivation unit 14 during atrial systole, during ventricular systole, or during both atrial systole and ventricular systole. Alternatively, heart beat cycle override unit 12 may receive continuous information from heart beat cycle indicating device 5/5' as to the heart beat cycle of the firearm operator, and override unit 12 may be programmed to actuate trigger deactivation unit 14 at pre-defined stages during the heart beat cycle of the firearm operator. For example, override unit 12 may be programmed such that trigger 60 is deactivated by trigger deactivation unit 14 during atrial systole, during ventricular systole, or during both atrial systole and ventricular systole.

Figure 4A:
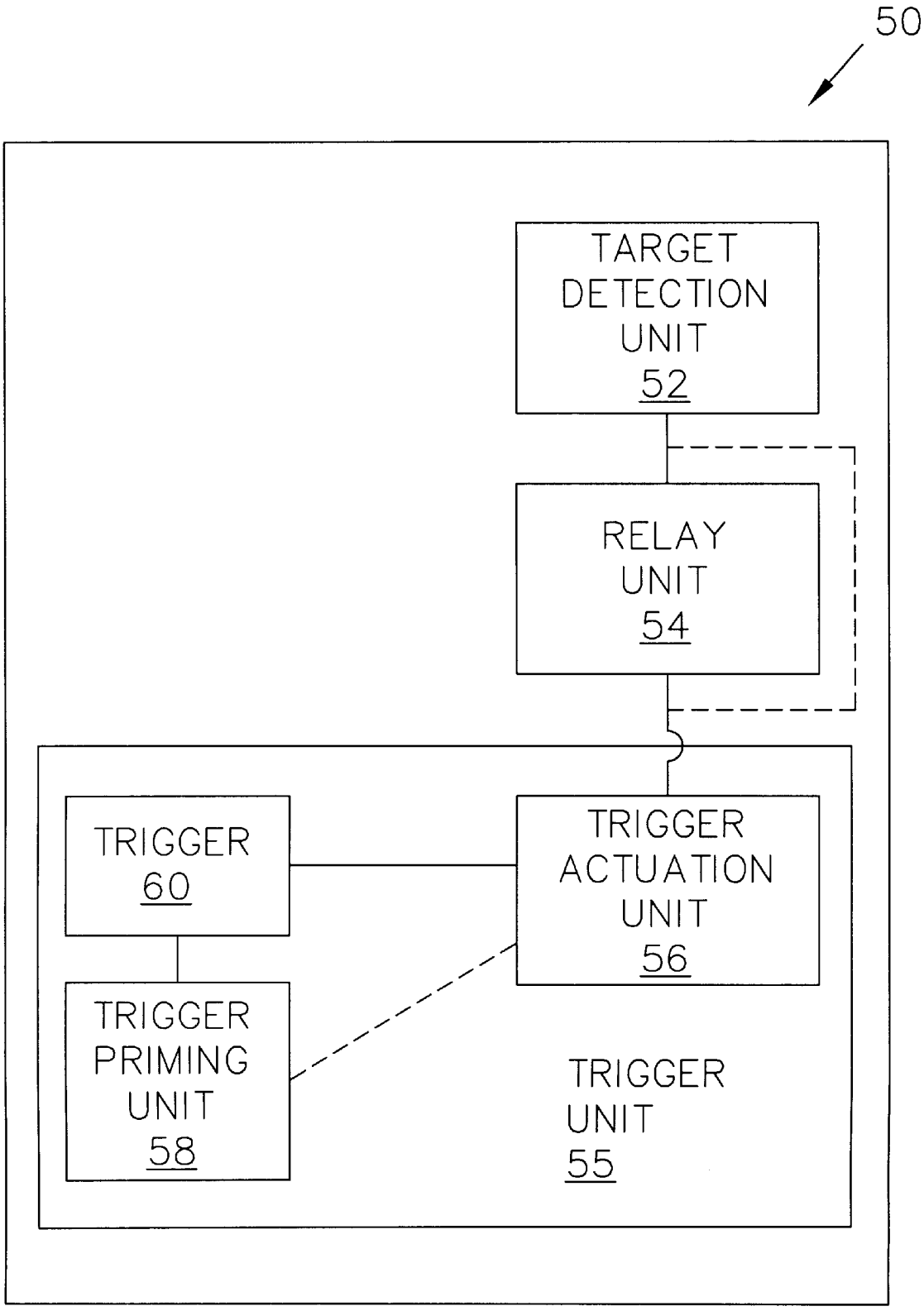
FIG. 4A is a box diagram to schematically represent an automatic firing assembly, according to another embodiment of the invention.

FIG. 4A is a box diagram to schematically represent an automatic firing assembly 50. According to one embodiment of the invention, automatic firing assembly 50 may be used to modify a conventional firearm to enable automatic discharge of the modified firearm upon alignment with a suitable target. (The term "automatic" as used in the context of an automatic firing assembly of the instant invention refers to discharge of a firearm, without the necessity for human intervention, in response to critical alignment of the firearm with a suitable target, and is not to be confused with the terms "fully automatic" and "semi-automatic" as defined hereinabove.) Automatic firing assembly 50 is capable of instigating automatic firing of a firearm, including a fully automatic or a semi-automatic firearm, in response to critical alignment of a target with the firearm, or with a target detection unit 52 associated with the firearm. Automatic firing assembly 50 includes target detection unit 52 which may be coupled to a relay unit 54, which in turn may be coupled to a trigger unit 55. Alternatively, target detection unit 52 may be coupled directly to trigger unit 55. Trigger unit 55 includes a trigger actuation unit 56, directly coupled to target detection unit 52 or connected to unit 52 via relay unit 54; a trigger 60, coupled to trigger actuation unit 56; and a trigger priming unit 58 coupled to trigger 60. Trigger actuation unit 56 may additionally be coupled to trigger priming unit 58.

Once a target with the appropriate electromagnetic "signature" is detected by target detection unit 52 as being aligned with the firearm, a message may be electronically relayed by relay unit 54 to trigger actuation unit 56. Trigger actuation unit 56 may then actuate trigger 60 to automatically fire the firearm. Preferably, trigger priming unit 58 is included as a component of trigger unit 55 such that trigger 60 and/or trigger actuation unit 56 must be primed or preconditioned in order to complete the "circuit" and allow trigger 60 to be actuated by trigger actuation unit 56 when an appropriate target is critically aligned with the firearm. Preferably some form of manual procedure is required to be preformed by the firearm operator in order to prime automatic firing assembly 50, for example, by the application of light to moderate pressure on trigger 60. Such a priming requirement adds a level of safety to the operation of automatic firing assembly 50 in combination with a firearm. Once automatic firing assembly 50 has been primed it may be left unattended in condition for automatic firing at a suitable target upon critical alignment therewith. For example, a weapon in combination with an automatic firing assembly may be mounted on a suitable firearm support structure (not shown) and the firearm/automatic firing assembly aimed or pointed at a trail, automatic firing assembly 50 primed by manually applying light pressure to trigger 60, and automatic firing assembly 50 left unattended to act as an unmanned booby trap.

Trigger actuation unit 56 may be programmed to provide for firing a specific number of rounds, e.g. as a burst of fire, upon receiving an electronic message from relay unit 54 that the firearm is critically aligned with an appropriate target. For example, according to one embodiment of the invention, trigger actuation unit 56 may be programmed to provide for automatic firing of a three-round burst upon critical alignment of the firearm with an appropriate target. Trigger actuation unit 56 may include a solenoid as part of a firing mechanism to effect firing of the firearm via trigger 60.

Figure 4B:
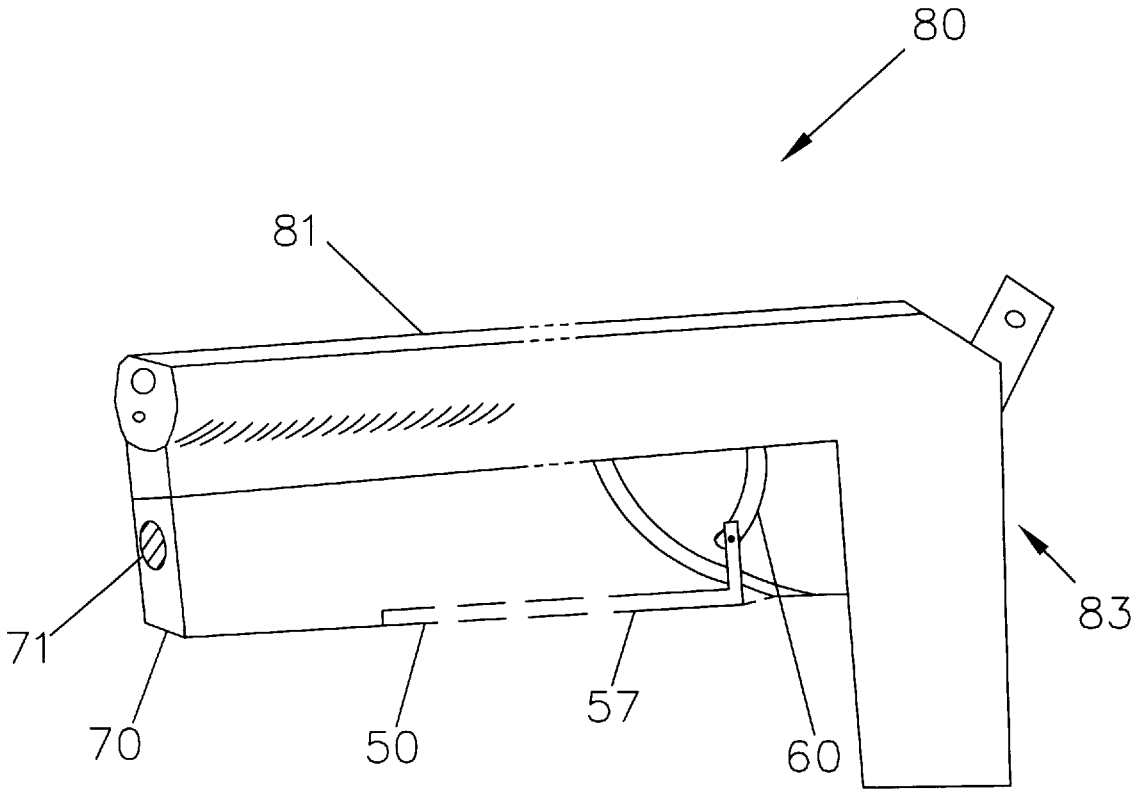
FIG. 4B schematically represents an automatic firing assembly for use in combination with a firearm, according to another embodiment of the invention.

FIG. 4B schematically represents an automatic firing assembly 50 for use in combination with a firearm 80. According to one embodiment of the invention, automatic firing assembly 50 may be included within an automatic fire module 70 for attachment to firearm 80, and for providing a mechanical interface to the trigger. According to one embodiment of the invention, automatic fire module 70 may be coupled to a conventional weapon for use in combination therewith. According to a preferred embodiment, automatic fire module 70 may be attached to firearm 80 generally beneath barrel 81. Automatic fire module 70 may include an aperture unit 71 for lens 53A (FIG. 4D). Trigger actuation unit 56 (FIG. 4A) may include a trigger control unit 57.

Target detection unit 52 (FIG. 4D) may be a detector capable of detecting a predetermined spectrum of electromagnetic radiation characteristic of a particular type of target. In one embodiment, a target detection unit 52 for the automatic detection of a target includes an infrared transmissive lens, an infrared filter, a chopper, and an infrared quad detector with the requisite associated electronics. For example, target detection unit 52 may include an infrared detector such as a low cost, non-imaging infrared detector capable of responding to a specified spectrum of infrared radiation, or infrared "signature", such as that characteristically emitted from the body of a human or other mammal. An example of a detector for detecting a target, according to the invention, is a pyroelectric quad detector (available from Molectron Detector, Inc., Portland, Oreg.) which may be combined with a chopper, a filter, and an infrared collimating lens system (FIG. 4D). The infrared lens provides for collection of radiation emanating from a relatively narrow field of view (e.g. an area about 3 feet in diameter at a distance of approximately 100 feet). Such a narrow field of view is necessary to reduce background radiation and to define a relatively small area from which to illuminate the quad detector. The infrared filter narrows the optical spectrum that is falling on the quad detector, and enables the selection of a particular target-emitted radiation frequency range or heat "signature" of interest.

The four signals from the quad detector can be processed to determine when a target is lined up, or critically aligned, with the firearm. Furthermore, in the case of a moving target the four signals from the quad detector can be processed to determine the angular velocity of the target across the field of view, and this determination can be used to discharge the weapon at an appropriate time in advance of the target becoming "centered" on the detector.

Figure 4C:
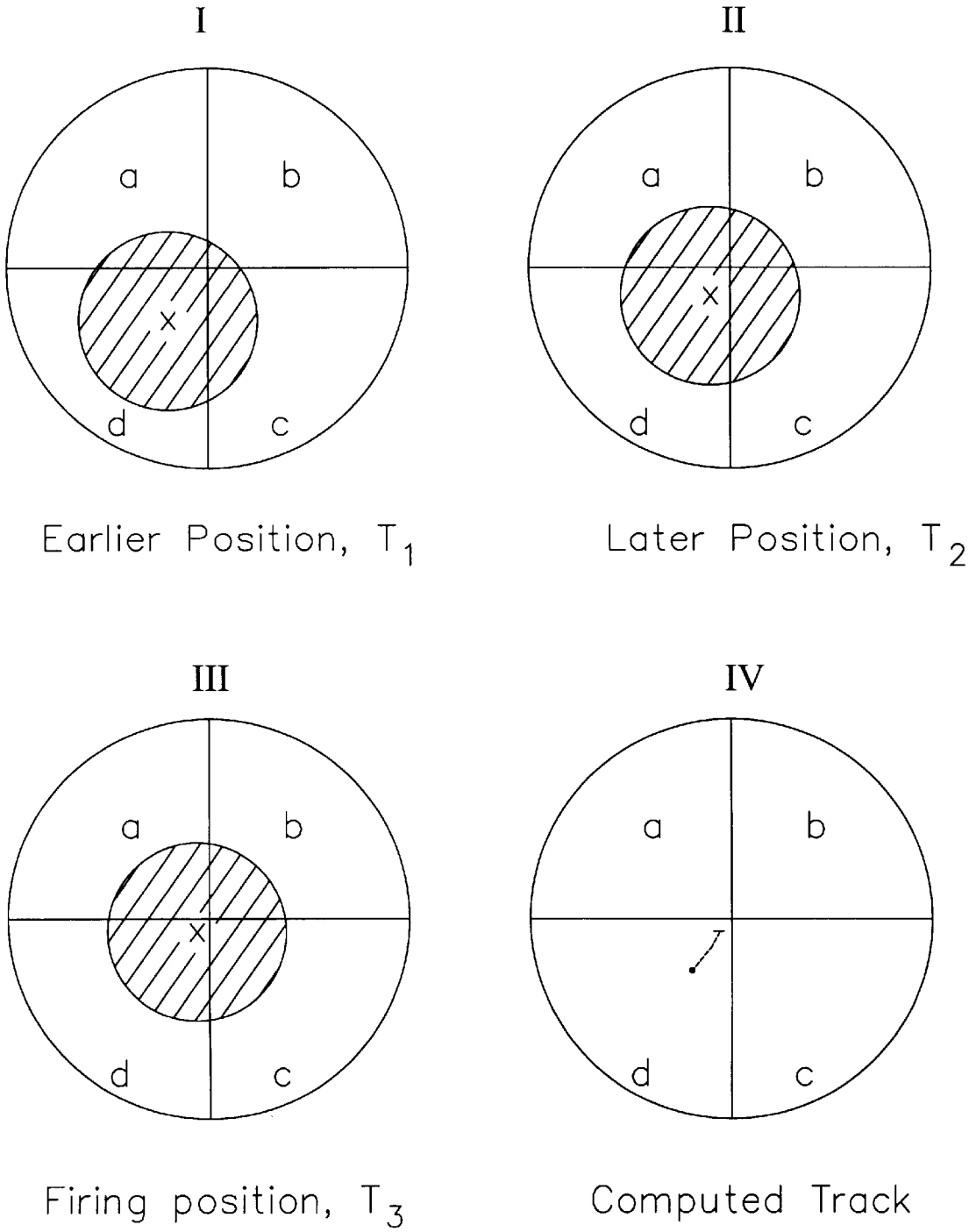
FIG. 4C schematically shows the successive positions of radiation originating from a moving target in relation to a quad detector, according to one embodiment of the invention.
Figure 4D:
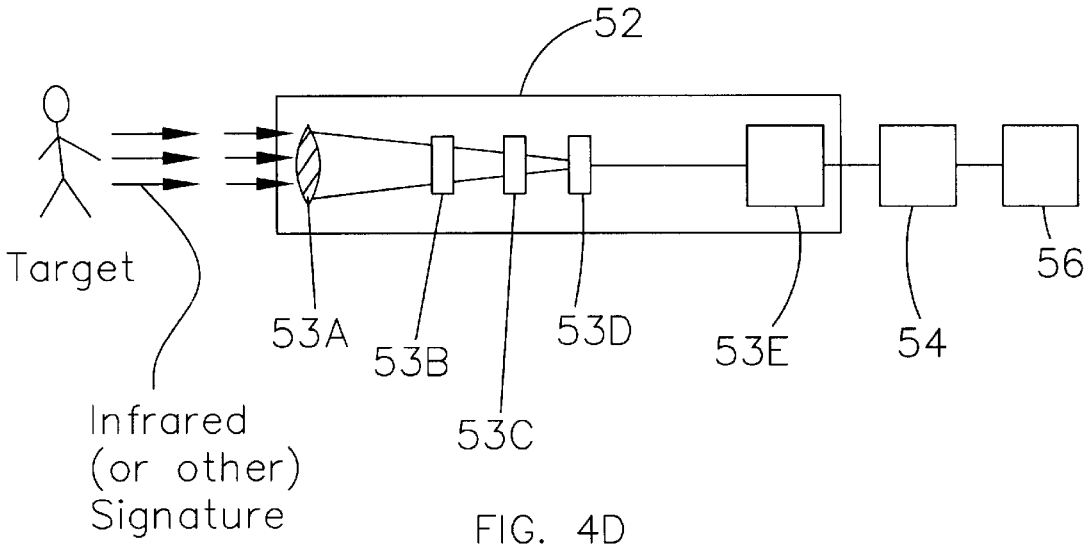
FIG. 4D schematically represents components of a target detection unit of an automatic firing assembly in relation to a target, according to another embodiment of the invention.

FIG. 4C schematically shows the successive positions of radiation originating from a moving target in relation to the four quadrants of a quad detector, in order to illustrate one embodiment of the invention. The outer circle in each panel I–IV encloses the four quadrants, a,b,c, and d of the detector. In panel I of FIG. 4C, at time $T_1$ the target radiation (represented by the shaded area) is predominantly within quadrant d. The center of the shaded area is marked with an "x". Subsequently, at time $T_2$ the target radiation has moved generally towards quadrant b, as shown in panel II of FIG. 4C. Later still, as the center of the target radiation approaches the center of the detector, the firing position is reached, as seen in panel III of FIG. 4C. In this way the firearm may be automatically fired in advance of the target being aligned with the center of the detector in order to allow, or compensate, for movement of the target. Panel IV of FIG. 4C shows the computed track of the center of the target radiation between $T_1$ and $T_3$, as represented by the dashed line. In FIG. 4C only two positions are shown at $T_1$ and $T_2$ prior to the firing position at $T_3$, whereas in practice a much larger number of positions may be detected for the purposes of determining the computed track of a moving target. The detection of a larger number of positions is particularly useful in situations where angular velocity of the target is changing or subject to change.

FIG. 4D schematically represents components of target detection unit 52 in relation to infrared or other electromagnetic radiation emitted from a target (such as a human target), an electronics processing unit, and a trigger actuation unit, according to another embodiment of the invention. Detection unit 52 may optionally include a lens 53A being transmissive to electromagnetic radiation emitted from the target, such as an infrared collimating lens system. Preferably, lens 53A is a zinc selinide lens, more preferably a zinc selinide lens having a diameter, F2 of a fraction of an inch to several inches and preferably approximately 0.75 inches. An optional filter 53B may be included to remove background radiation. Filter 53B comprises a chopper running at a frequency of in the one to several tens of KHz and preferably about 10 KHz. After filter 53B, a chopper 53C may optionally be included to modulate the signal. According to a preferred embodiment, chopper 53C may comprise a notch filter passing 3–4 micrometers. Target detection unit 52 further includes a detector 53D responsive to the radiation emitted from the target. A currently preferred detector comprises an infrared quadrant detector with built-in preamplifiers. Other detectors which may be used under the invention include a CCD array, and a thermal array. Trigger actuation unit 52 still further includes an electronics processing unit 53E. Preferably, electronics processing unit 53E includes an analog processor with AD outputs, in combination with a digital processor and 8 bit controller. Target detection unit 52 may be coupled to trigger actuation unit 56 via relay unit 54, as described hereinabove with reference to FIG. 4A.

According to one embodiment of the invention, an automatic firing assembly 50/50' may include an electronic Identify Friend or Foe (IFF) feature. According to a currently preferred embodiment, an IFF feature may be arranged as follows. All friendly personnel engaged in a particular operation deploying one or more automatic firing assemblies 50/50' may carry or display an IFF coded signal source, such as an infrared LED, which emits a coded signal in the passband of target detection unit 52. The coded signal serves to prevent automatic firing when the firearm and target detection unit 52 are critically aligned with a friendly target. Such a coding signal may be programmed, for example, prior to commencement of an operation deploying one or more automatic firing assemblies 50/50'. Preferably, the coding signal has a frequency which is higher than the chopper frequency of target detection unit 52, and preferably quad detector electronics include a separate channel for decoding the IFF signal. Automatic firing assembly 50/50' may be configured either to permit manual operation of the firearm (trigger position 60C of FIG. 4E) during detection of the coded signal from a friendly target, or to prevent manual operation of the firearm during detection of that coded signal.

Figure 4E:
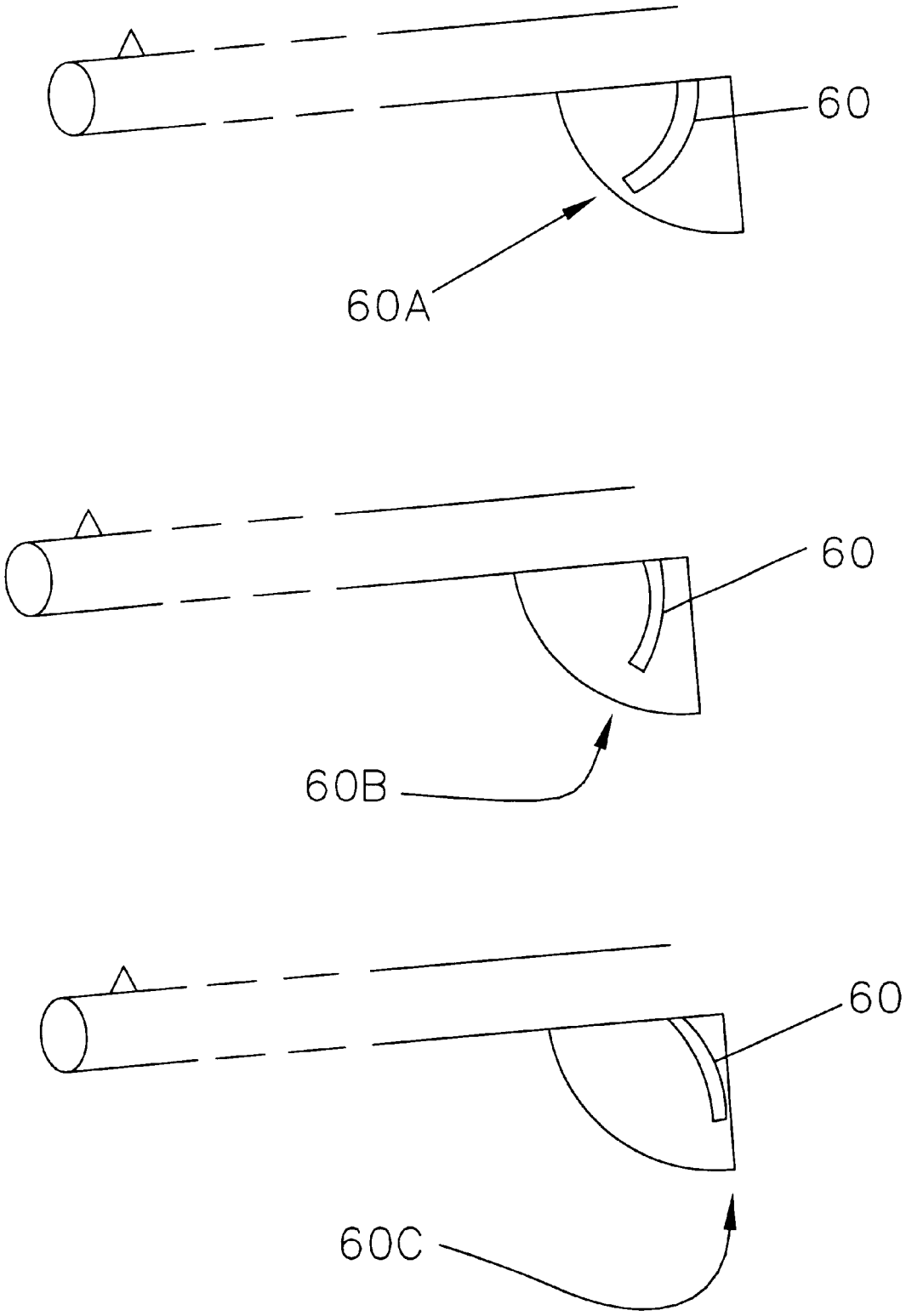
FIG. 4E schematically represents the different positions of a firearm trigger, according to another embodiment of the invention.

FIG. 4E schematically shows the different positions of a firearm trigger 60 of a firearm, according to one embodiment of the invention, in which trigger 60 may assume different functional positions designated as 60A–60C. A trigger coupling unit 59 (FIG. 4F) may be coupled to trigger 60. Position 60A of trigger 60 represents a neutral position corresponding to an unarmed condition for automatic firing assembly 50. Position 60B represents the primed position corresponding to an armed condition for automatic firing assembly 50. Trigger 60 may be moved from position 60A to position 60B by the application of light to moderate pressure on trigger 60, such as may be exerted by gently squeezing with the finger(s) of an operator of the firearm. With trigger 60 in position 60B, trigger 60 will remain in position 60B until it is manually moved to position 60A or 60C by the firearm operator. Trigger 60 may be moved to the third position 60C, from either of positions 60B or 60A (via position 60B) by the application of strong or full pressure to trigger 60. When trigger 60 is moved to position 60C the firearm is manually discharged in a manner somewhat analogous to the operation of a conventional (i.e. nonautomatically firing) firearm. In this way, manual firing is enabled in the event of a system malfunction or power (battery) failure. With trigger 60 in position 60C, after pressure ceases to be exerted on trigger 60 by the firearm operator, trigger 60 will return to either position 60B or 60A.

Figure 4F:
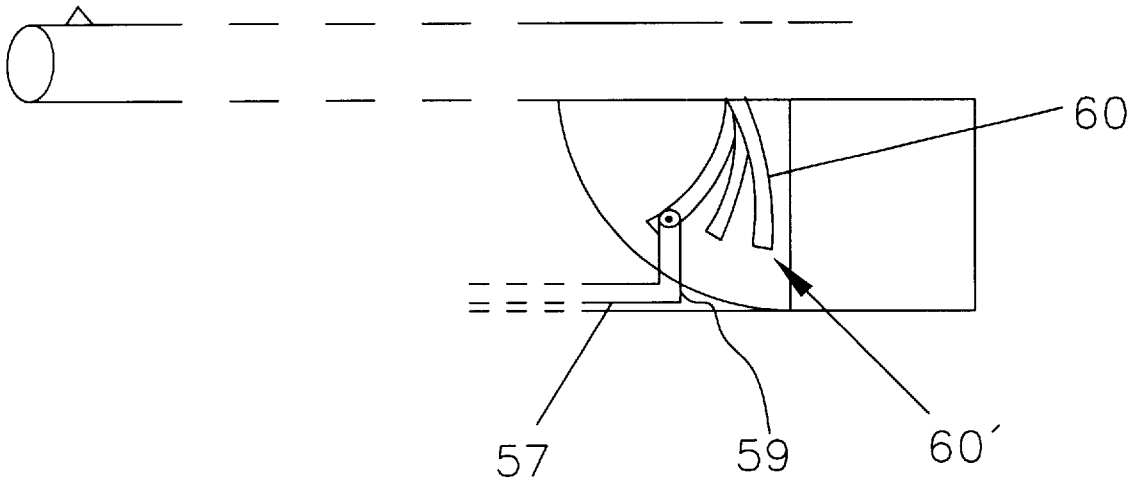
FIG. 4F schematically shows coupling of a firearm trigger to a trigger coupling unit of an automatic firing assembly, according to another embodiment of the invention.

FIG. 4F schematically shows coupling of firearm trigger 60 at distal end 60' to trigger coupling unit 59, according to one embodiment of the invention. Such coupling may be via a pin or other mechanism well known in the art. Trigger coupling unit 59 may be coupled to, or be an extension of, trigger control unit 57.

Trigger coupling unit 59 and/or trigger control unit 57 may be coupled to a trigger position sensing unit (not shown) for sensing the position of trigger 60, i.e. 60A, 60B, or 60C.

Figure 5A:
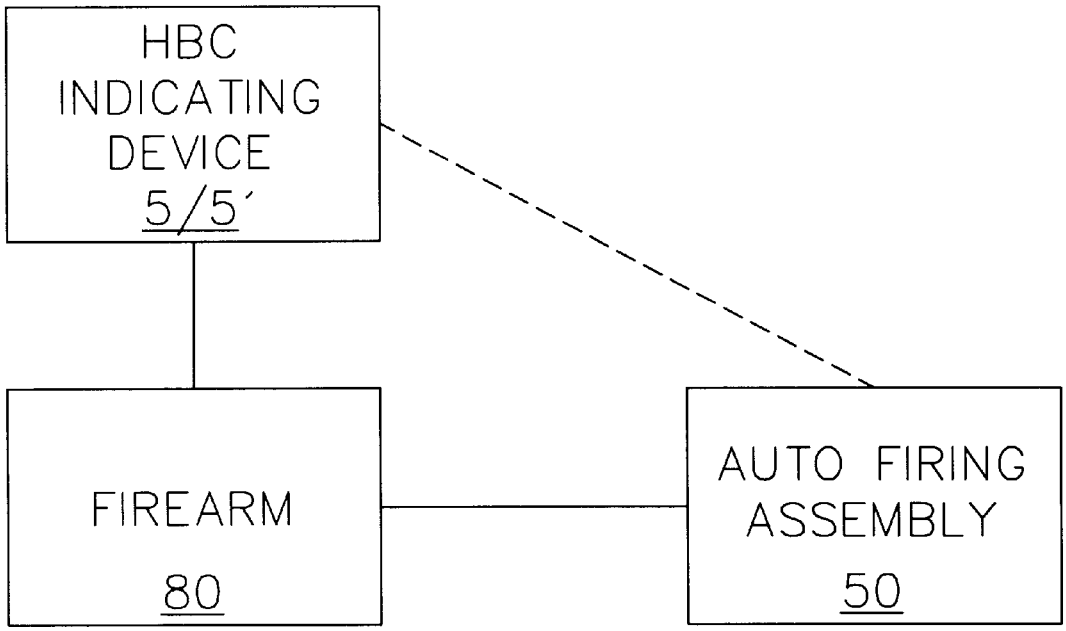
FIG. 5A is a box diagram to schematically represent how a heart beat cycle indicating device and an automatic firing assembly may each be configured with a firearm, according to one embodiment of the invention.

FIG. 5A is a box diagram to schematically represent how a heart beat cycle indicating device and an automatic firing assembly may each be configured with a firearm 80, according to one embodiment of the invention. According to FIG. 5A, firearm 80 may be configured with both a heart beat cycle indicating device 5/5' and with an automatic firing assembly 50, such that both heart beat cycle indicating device 5/5' and automatic firing assembly 50 can interact with firearm 80 independently of each other. According to one embodiment of the invention, heart beat cycle indicating device 5/5' and automatic firing assembly 50 may also be configured with each other to operate in concert (e.g. FIG. 5B).

Figure 5B:
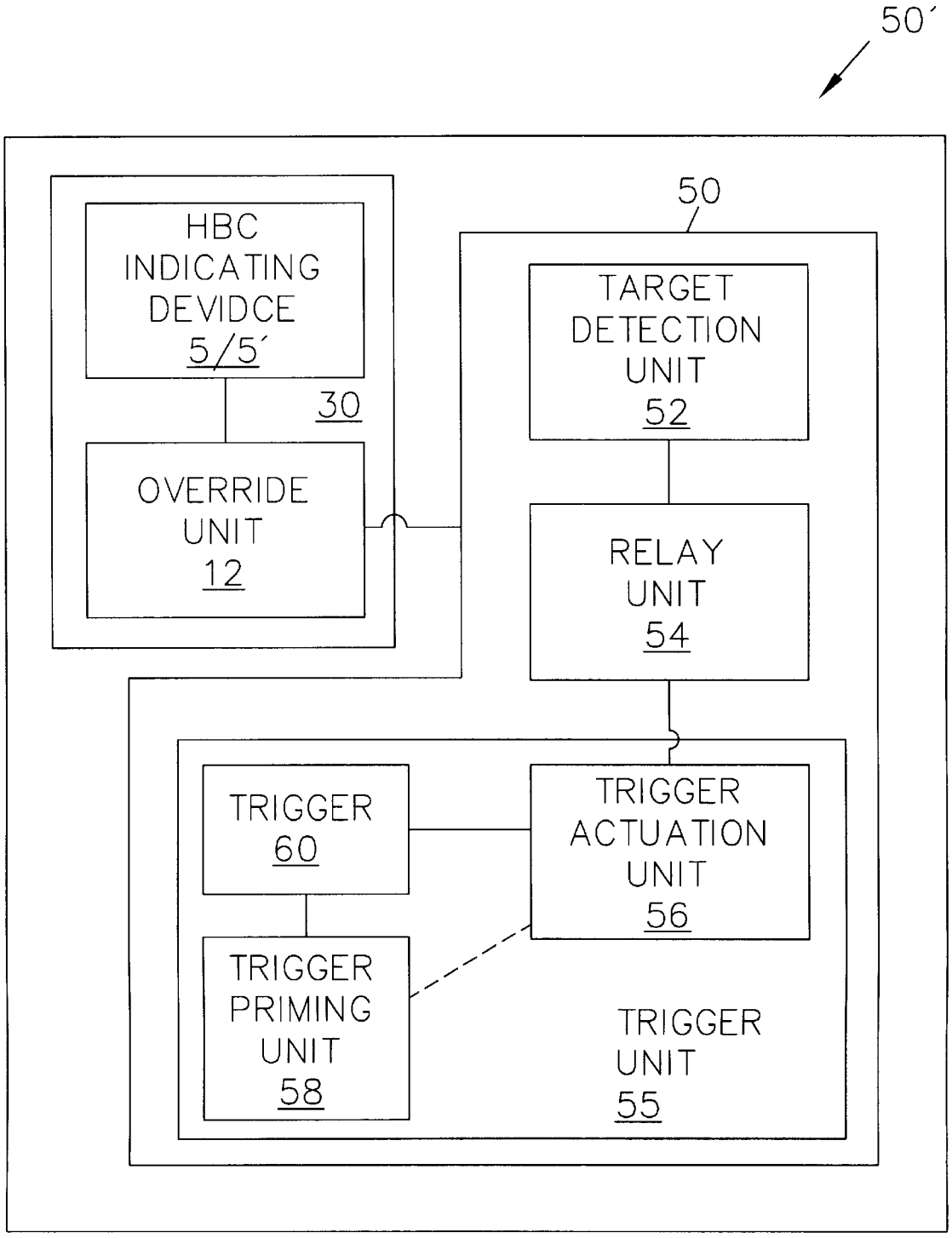
FIG. 5B is a box diagram to schematically represent how a heart beat cycle indicating and override device may be configured with an automatic firing assembly, according to one embodiment of the invention.

FIG. 5B is a box diagram to schematically represent an automatic firing assembly 50' including a heart beat cycle override device 30, according to one embodiment of the invention. Automatic firing assembly 50' may include the same components as automatic firing assembly 50 described hereinabove with reference to FIG. 4A. In addition, automatic firing assembly 50' may be combined with heart beat cycle override device 30. In particular, override unit 12 of heart beat cycle override device 30 may be coupled to one or more components of automatic firing assembly 50 in order to prevent or deactivate automatic firing of a firearm by automatic firing assembly 50 during one or more defined stages during the heart beat cycle of the firearm operator. Thus, according to this embodiment of the invention, heart beat cycle override device 30 can transiently or intermittently override automatic fire of a firearm which would otherwise fire automatically when an appropriate target is aligned with the firearm.

Heart beat cycle override device 30 includes a heart beat cycle indicating device 5/5', as described hereinabove with reference to FIGS. 1A–2D, which is coupled to a heart beat cycle override unit 12. Heart beat cycle override unit 12 may be programmed to override automatic firing of a firearm during one or more specified stages of the heart beat cycle of the firearm operator as monitored by heart beat cycle monitoring unit 10. For example, heart beat cycle override unit 12 may be programmed to override automatic firing of a firearm during atrial systole, during ventricular systole, or during both atrial systole and ventricular systole.

Heart beat cycle override unit 12 may be coupled to various components of assembly 50' in order to intermittently or transiently prevent trigger 60 from being actuated. For example, heart beat cycle override unit 12 may be coupled to relay unit 54 to prevent relay of an electronic message from target detection unit 52 to trigger actuation unit 56. Alternatively, heart beat cycle override unit 12 may be coupled to trigger actuation unit 56 to intermittently block or inactivate trigger actuation unit 56. Other configurations and strategies to transiently and/or intermittently block firing by automatic firing assembly 50/50' will be evident to those skilled in the art in light of the teachings herein.

Each of the devices described hereinabove may incorporate a user identification feature in order to prevent unauthorized use of the respective devices, as is well known in the art. A user identification feature would be particularly valuable in the case of an automatic firing assembly in combination with a fully automatic weapon.

Figure 6A:
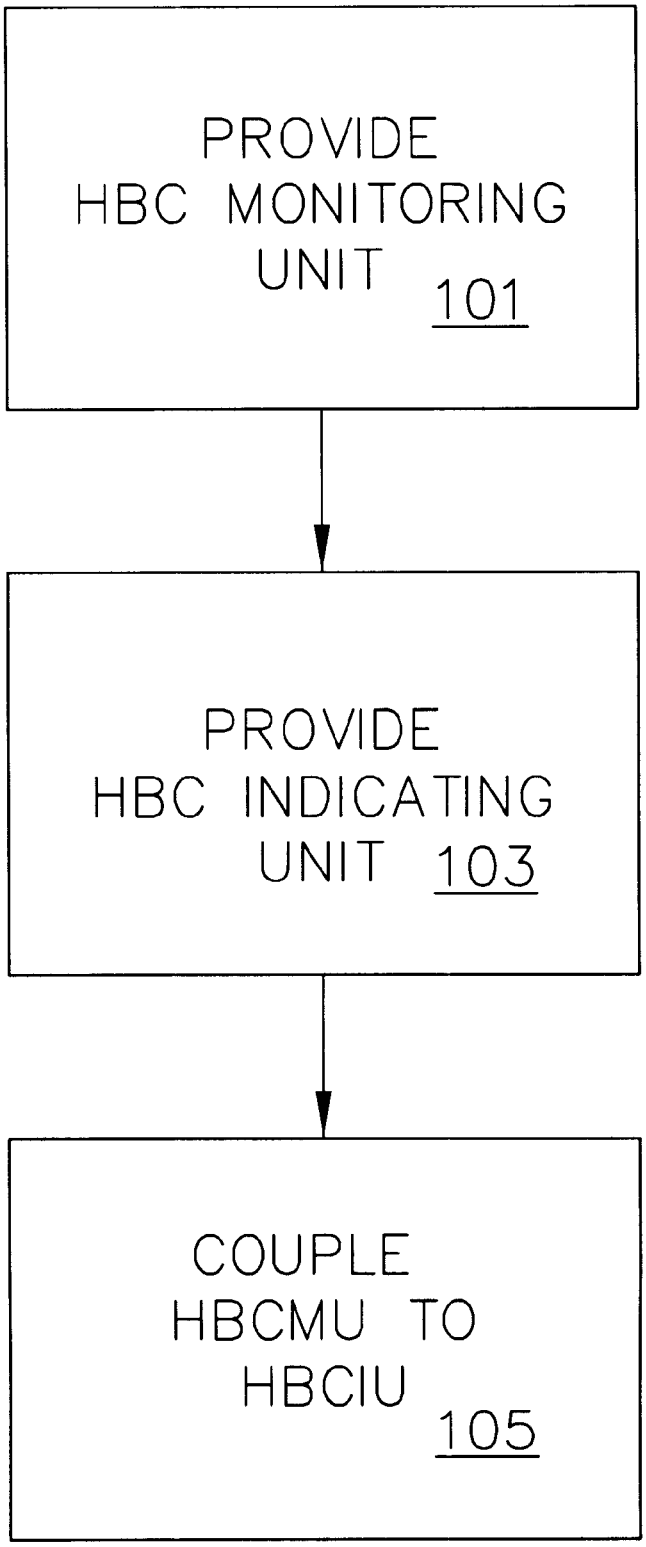
FIG. 6A summarizes the steps involved in a method for making a heart beat cycle indicating device, according to another embodiment of the invention.

FIG. 6A summarizes the steps involved in a method for making a heart beat cycle indicating assembly, according to another embodiment of the invention, in which step 101 involves providing a heart beat cycle monitoring unit. Step 103 involves providing a heart beat cycle indicating unit. Step 105 involves coupling the heart beat cycle indicating unit to the heart beat cycle monitoring unit. Optionally, according to one embodiment of the invention, in lieu of step 105 a heart beat cycle signal unit (FIG. 1B) may be coupled between the heart beat cycle monitoring unit and the heart beat cycle indicating unit.

Figure 6B:
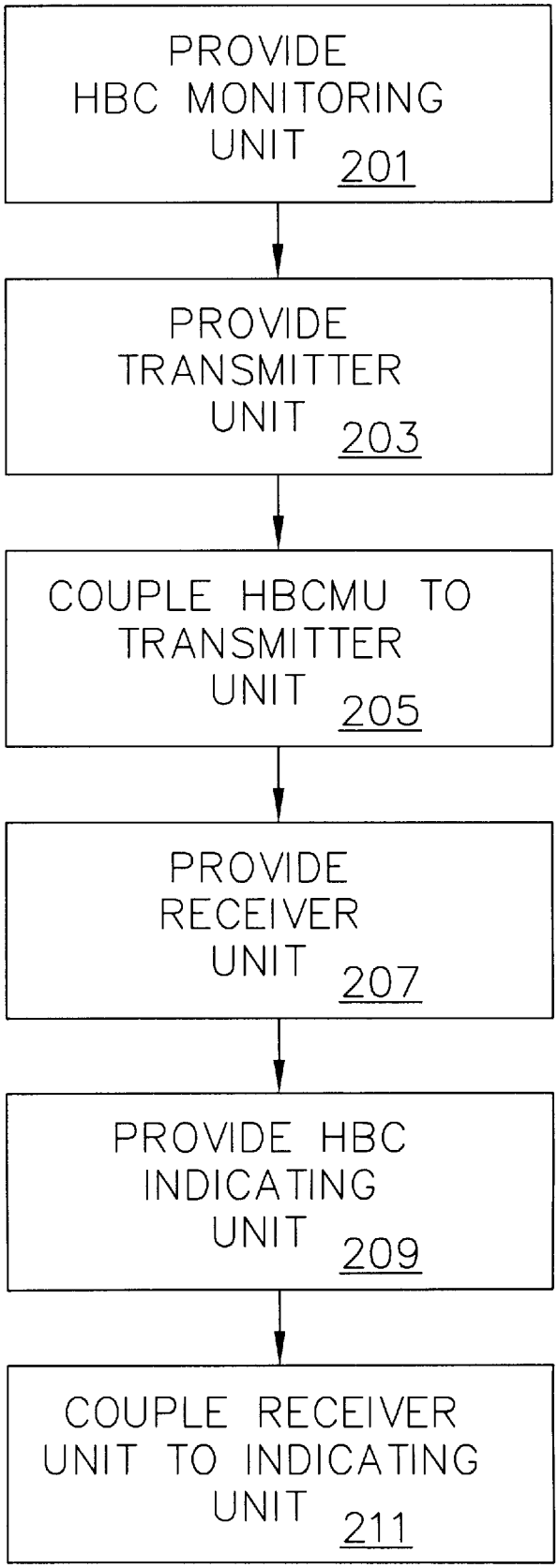
FIG. 6B summarizes the steps involved in a method for making a heart beat cycle indicating assembly, according to another embodiment of the invention.

FIG. 6B summarizes the steps involved in a method for making a heart beat cycle indicating device, according to another embodiment of the invention, in which step 201 involves providing a heart beat cycle monitoring unit. Step 203 involves providing a transmitter unit. Step 205 involves coupling the heart beat cycle monitoring unit to the transmitter unit. Step 207 involves providing a receiver unit. Step 209 involves providing a heart beat cycle indicating unit which may include a display unit, a source of illumination, and\or a source of sound such as a beeper providing one beep or a series of beeps each time the sound source is activated. Step 211 involves coupling the receiver unit to the heart beat cycle indicating unit. Alternatively, after step 201 a heart beat cycle signal unit may be coupled to the heart beat cycle monitoring unit, in which case, in lieu of step 205 the heart beat cycle signal unit may be coupled to the transmitter unit.

Figure 7:
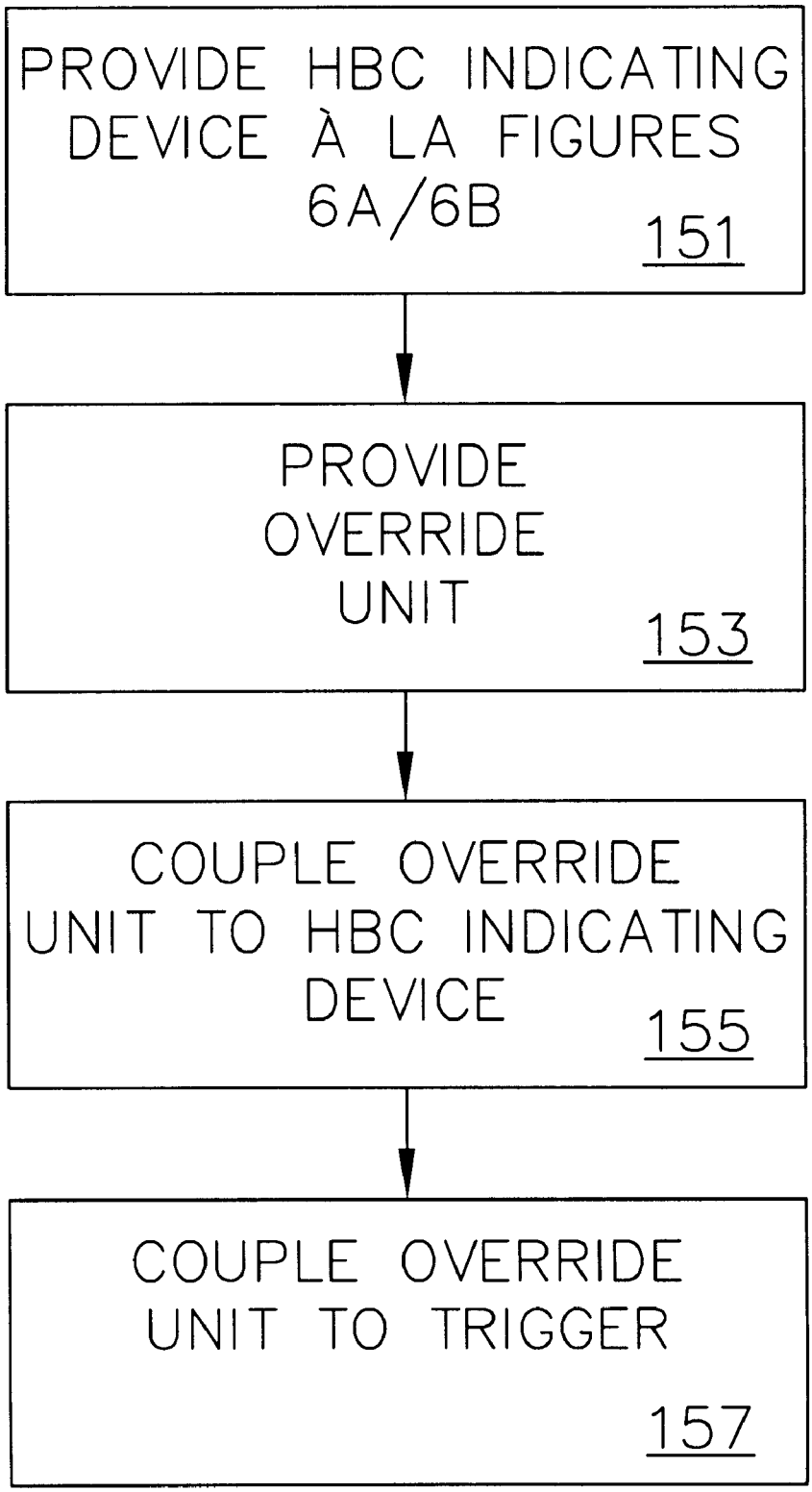
FIG. 7 summarizes the steps involved in a method for making a heart beat cycle indicating device in combination with a heart beat cycle override device, according to another embodiment of the invention.

FIG. 7 summarizes the steps involved in a method for making a heart beat cycle indicating device in combination with a heart beat cycle override device for use in conjunction with a firearm, according to another embodiment of the invention, in which step 151 involves providing a heart beat cycle indicating device according to steps 101 through 105 as described hereinabove with reference to FIG. 6A or according to steps 201 through 211 as described hereinabove with reference to FIG. 6B. Step 153 involves providing a heart beat cycle override unit. Step 155 involves coupling the heart beat cycle override unit provided in step 153 to the heart beat cycle indicating device provided in step 151. The heart beat cycle override unit may be coupled to the heart beat cycle monitoring unit, or to various components "downstream" of the heart beat cycle monitoring unit, as may be readily apparent to those skilled in the art. Step 157 involves coupling the heart beat cycle override unit to a trigger of the firearm to be operated in conjunction with the heart beat cycle indicating device and heart beat cycle override device. According to one embodiment of the invention, an additional step of providing a trigger deactivation unit may be involved in the method represented in FIG. 7, in which case the trigger deactivation unit may be coupled between the heart beat cycle override unit and the firearm trigger.

Figure 8:
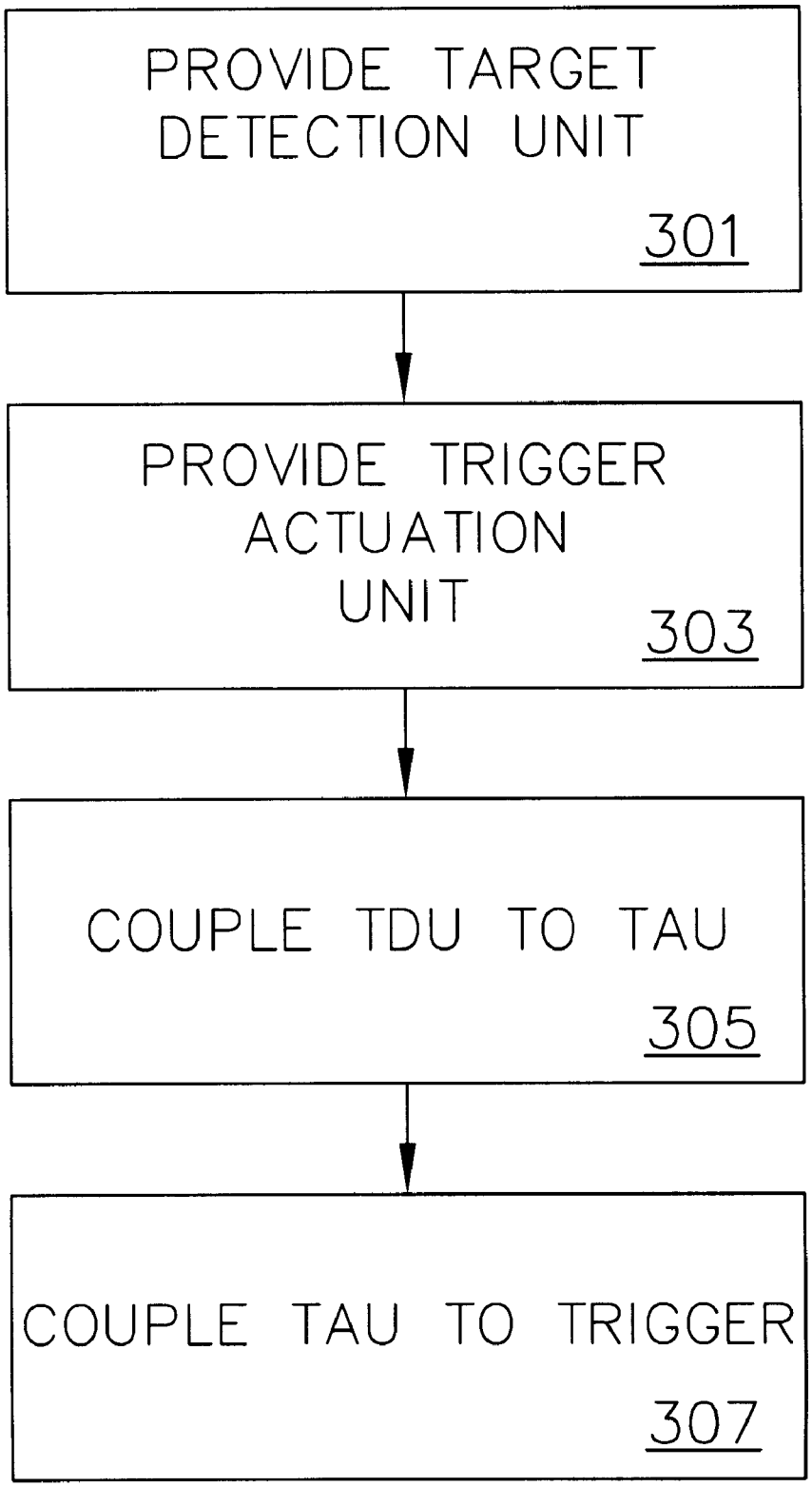
FIG. 8 summarizes a series of steps involved in a method for making an automatic firing assembly, according to another embodiment of the invention.

FIG. 8 summarizes a series of steps involved in a method for making an automatic firing assembly for a firearm, according to another embodiment of the invention. Step 301 involves providing a target detection unit. Step 303 involves providing a trigger actuation unit. Step 305 involves coupling the target detection unit to the trigger actuation unit. In lieu of step 305, a relay unit may be coupled between the target detection unit and the trigger actuation unit. Subsequently, in step 307 the trigger actuation unit may be coupled to the trigger of the firearm. According to a method of making an automatic firing assembly, a trigger priming unit may be provided to prime or precondition the automatic firing assembly such that, when a target is aligned with the firearm, the automatic firing assembly will not initiate firing of the firearm unless the automatic firing assembly is primed by the trigger priming unit. Furthermore, according to a method of making an automatic firing assembly, the trigger priming unit is coupled to the trigger of the firearm, and the trigger priming unit may also be coupled to the trigger actuation unit (FIG. 4A).

Figure 9:
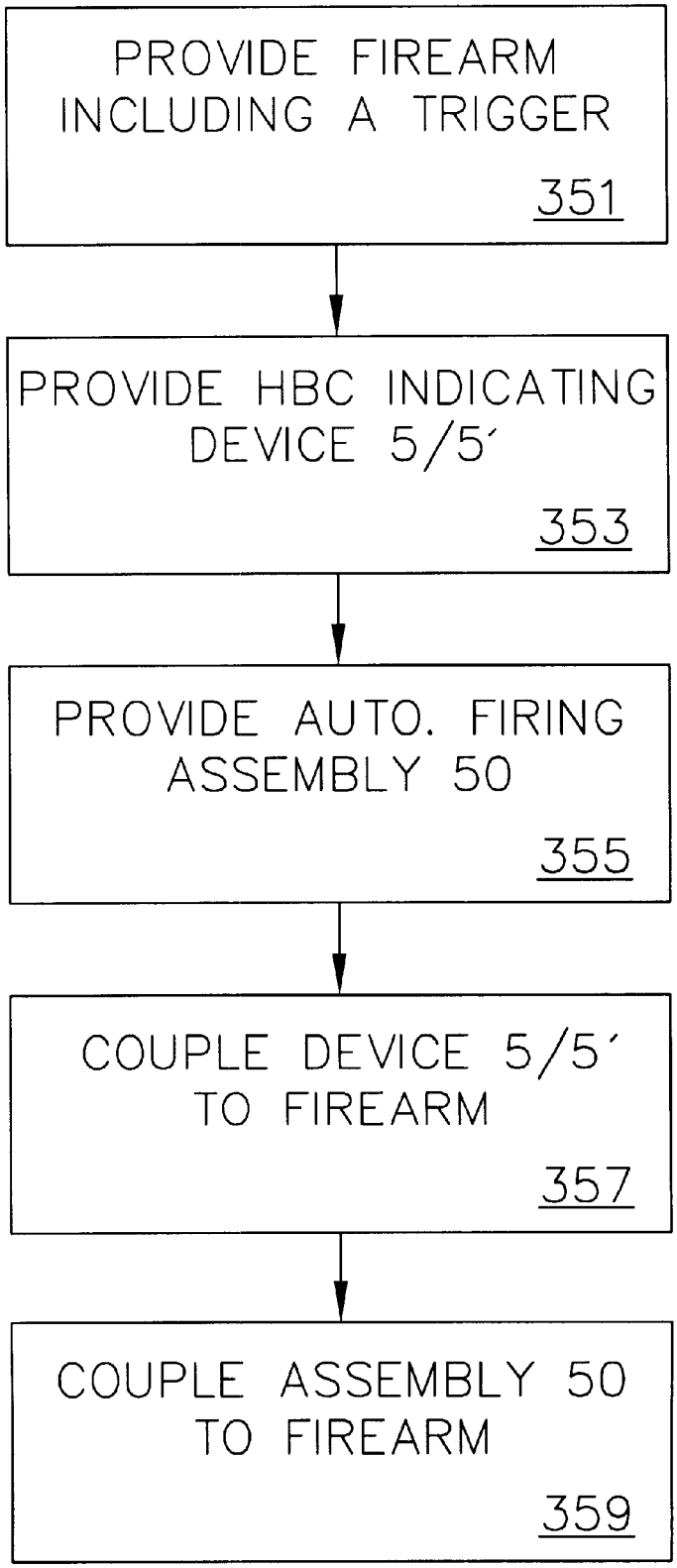
FIG. 9 summarizes a series of steps involved in a method for configuring a firearm with both a heart beat cycle indicating device and an automatic firing assembly, according to another embodiment of the invention.

FIG. 9 summarizes a series of steps involved in a method of providing a heart beat cycle indicating device/automatic firing assembly/firearm combination, according to another embodiment of the invention. Step 351 involves providing a firearm including a trigger. Step 353 involves providing a heart beat cycle indicating device 5/5' having a heart beat cycle indicating unit. Step 355 involves providing an automatic firing assembly 50 having a trigger actuation unit. Step 357 involves coupling one or more components of the heart beat cycle indicating device 5/5' to the firearm, as described hereinabove with reference to FIGS. 1A–1D and 2A–2D. According to a currently preferred embodiment, the heart beat cycle indicating unit of the heart beat cycle indicating device may be coupled to a sighting device of the firearm. Step 359 involves coupling the trigger actuation unit of automatic firing assembly 50 to the trigger of the firearm. According to one embodiment of the invention, optionally, an additional step (not shown) of coupling the heart beat cycle indicating device 5/5' to the automatic firing assembly 50 may be involved, whereby it is possible for device 5/5' and assembly 50 to work in concert.

Figure 10:
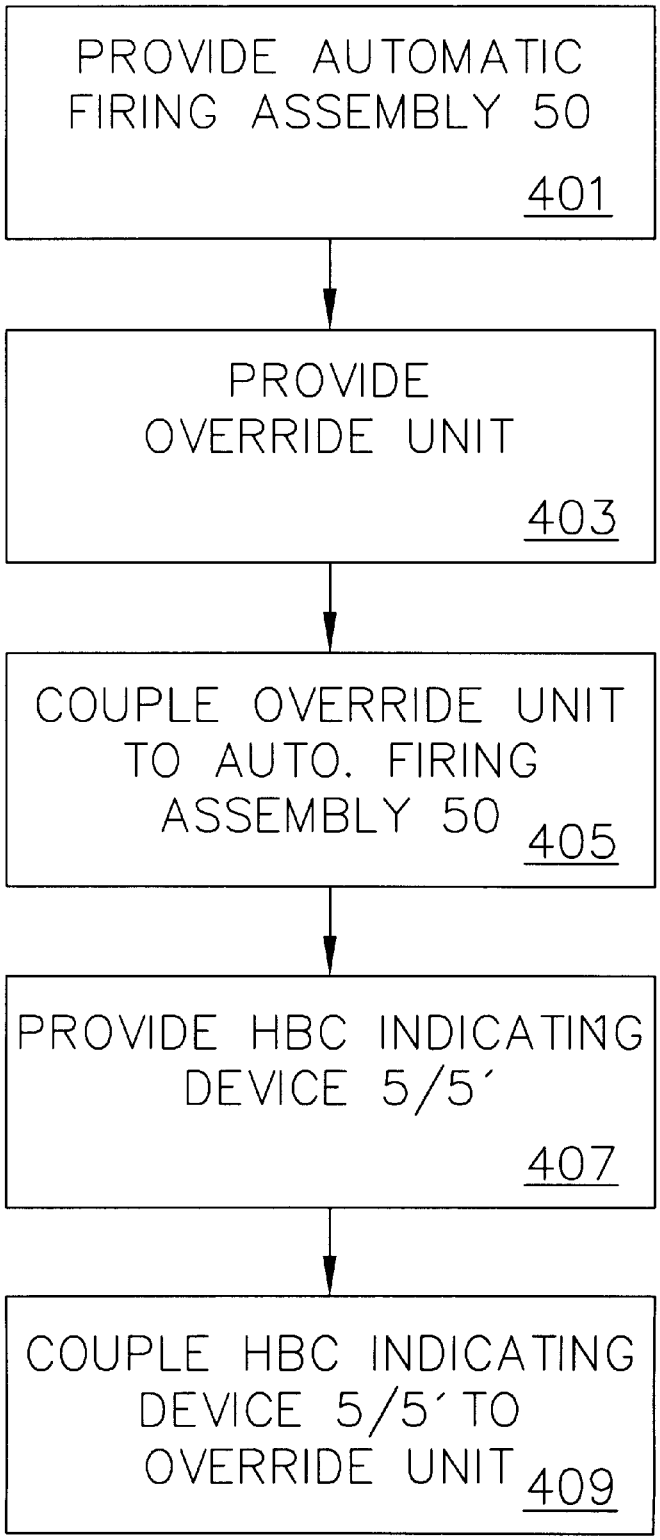
FIG. 10 summarizes a series of steps involved in a method for making an automatic firing assembly including a heart beat cycle override feature, according to another embodiment of the invention.

FIG. 10 summarizes a series of steps involved in a method for making an automatic firing assembly which includes a heart beat cycle override feature, according to another embodiment of the invention. Thus, step 401 involves providing an automatic firing assembly, for example, according to the method described hereinabove with reference to FIG. 8. Step 403 involves providing a heart beat cycle override unit. Step 405 involves coupling the heart beat cycle override unit to the automatic firing assembly provided in step 401. Step 407 involves providing a heart beat cycle indicating device. Step 409 involves coupling the heart beat cycle indicating device to the heart beat cycle override unit.

Figure 11:
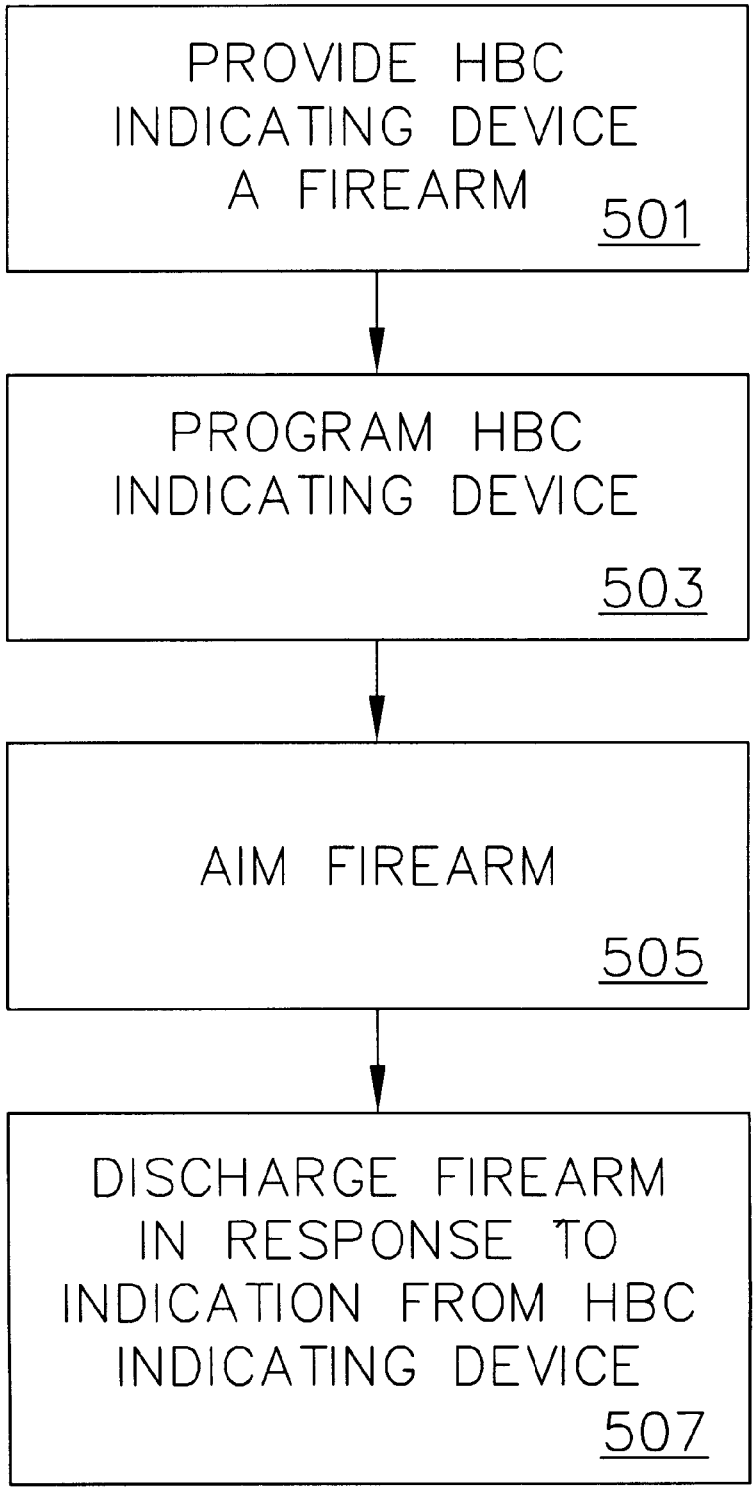
FIG. 11 shows a series of steps involved in a method for operating a firearm in combination with a heart beat cycle indicating device, according to another embodiment of the invention.

FIG. 11 summarizes a series of steps involved in a method for operating a firearm in combination with a heart beat cycle indicating device, according to another embodiment of the invention. Thus step 501 involves providing a heart beat cycle indicating device and a firearm, wherein the heart beat cycle indicating device includes a heart beat cycle indicating unit, and the heart beat cycle indicating unit is capable of providing a heart beat cycle indication to a firearm operator of an appropriate time to discharge the firearm with respect to the heart beat cycle of the firearm operator. Step 503 involves programming the heart beat cycle indicating device to provide an appropriate heart beat cycle indication to the firearm operator. Step 505 involves aiming the firearm at a target. Step 507 involves discharging the firearm in response to the heart beat cycle indication provided by the heart beat cycle indicating unit, while maintaining the aim of the firearm at the target. Preferably, step 507 involves pulling on the trigger of the firearm by the firearm operator in response to the heart beat cycle indication from the heart beat cycle indicating unit.

Figure 12:
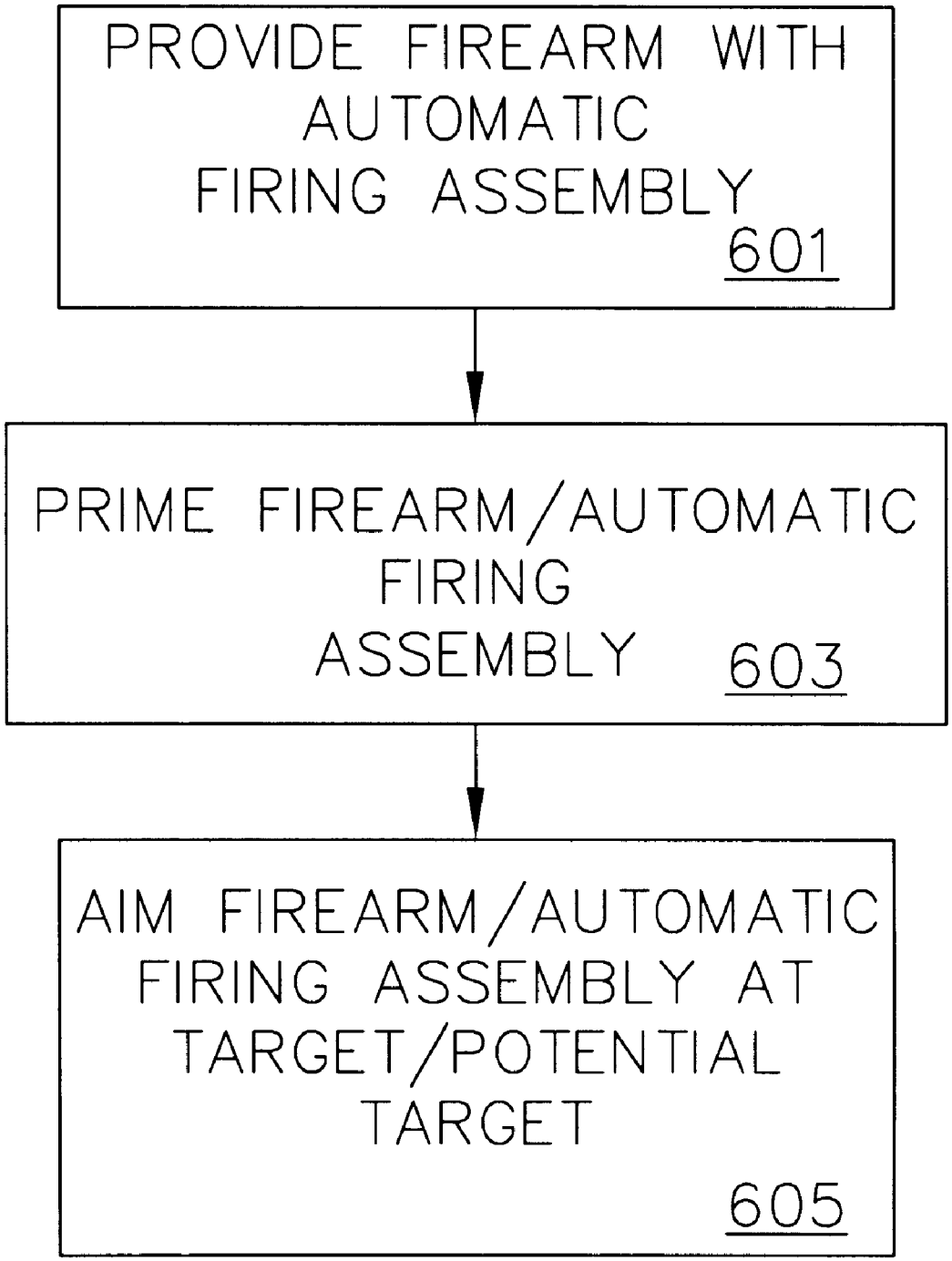
FIG. 12 summarizes the steps involved in a method for operating a firearm/automatic firing assembly, according to another embodiment of the invention.

FIG. 12 summarizes a series of steps involved in a method for operating a firearm equipped with an automatic firing assembly, according to another embodiment of the invention. Step 601 involves providing a firearm in combination with an automatic firing assembly. Step 603 involves priming the firearm/automatic firing assembly. As an example, step 603 may entail applying light to moderate pressure on the firearm trigger, wherein the trigger is coupled to a trigger priming unit. Step 605 involves aiming the firearm/automatic firing assembly at a target or potential target. For example, step 605 may entail aiming the firearm/automatic firing assembly at a specific moving or stationary target, or aiming the firearm/automatic firing assembly in a particular direction from which a potential target is anticipated. In the latter situation, optional step 607 (not shown) may involve supporting the firearm/automatic firing assembly on a suitable firearm support structure for unattended operation, and leaving the firearm/automatic firing assembly unattended on the firearm support structure.

According to one embodiment of the invention, a method for discharging a firearm equipped with an automatic firing assembly may optionally involve, prior to step 603, programming the automatic firing assembly to fire in response to a particular spectrum of electromagnetic radiation or electromagnetic "signature". In addition, a method for discharging a firearm equipped with an automatic firing assembly may optionally involve, prior to step 603, programming the automatic firing assembly not to fire in response to a particular electromagnetic "signature" or signal emanating from a potential target, e.g. a coded signal emanating from a friendly target. For example, a friendly target may display an infrared LED which emits a coded signal in the passband of target detection unit 52, and which serves to prevent automatic firing of the firearm upon critical alignment with the friendly target. According to another embodiment of the invention, a method for discharging a firearm equipped with an automatic firing assembly may optionally involve, prior to step 603, programming the automatic firing assembly to fire a specific number of rounds, e.g. as a burst of fire, upon critical alignment of the firearm with an appropriate target. For example, trigger actuation unit 56 may be programmed to provide for automatic firing of a three-round burst upon critical alignment of the firearm with an appropriate target. According to another embodiment of the invention, a method for discharging a firearm equipped with an automatic firing assembly may optionally involve, at any time point after step 601, aiming the firearm/automatic firing assembly combination at a target and manually discharging the firearm. As an example, the firearm may be discharged by the application of full pressure on the firearm trigger (position 60C, FIG. 4E).

Although the heart beat cycle indicating device of the instant invention has been described herein primarily with respect to operating a firearm, apparatus of the instant invention may find other applications where individuals operating instruments, machinery, etc. could improve their performance by being aware of the stage of their heart beat cycle while performing a finely controlled or delicate procedure.

The foregoing embodiments are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

What is claimed is:

1. A heart beat cycle indicating device, to indicate to a firearm operator an appropriate point in time at which to fire a firearm, comprising:

a heart beat cycle monitoring unit to monitor a heart beat cycle of the firearm operator; and a heart beat cycle indicating unit, coupled to said heart beat cycle monitoring unit, to determine and indicate to the firearm operator an optimum point in time at which to fire the firearm, the optimum point in time being temporally related to a defined stage of the heart beat cycle of the firearm operator.

2. The heart beat cycle indicating device of claim 1, further comprising a heart beat cycle signal unit to transfer a heart beat cycle-related signal from said heart beat cycle monitoring unit to said heart beat cycle indicating unit.

3. The heart beat cycle indicating device of claim 1, further comprising an override unit capable of preventing firing of the firearm during one or more defined stages of the heart beat cycle of the firearm operator.

4. The device of claim 3, wherein said override unit is coupled to receive a heart beat cycle signal from said heart beat cycle monitoring unit, and disables a trigger of the firearm during one or more prescribed periods of the heart beat cycle.

5. The heart beat cycle indicating device of claim 1, further comprising a transmitter unit to transmit electromagnetic radiation, and a receiver unit to receive electromagnetic radiation, wherein said transmitter unit is coupled to said heart beat cycle monitor unit, and said receiver unit is coupled to said heart beat cycle indicating unit.

6. The heart beat cycle indicating device of claim 1, wherein said heart beat cycle indicating unit comprises at least one of a video device and an audio device.

7. The heart beat cycle indicating device of claim 1, wherein said heart beat cycle monitoring unit comprises one of a photoplethysmographic device and an EKG-sensitive device.

8. The device of claim 1, further comprising a trigger actuation unit coupled to a trigger and to said heart beat monitoring unit to automatically fire the firearm in response to a signal monitoring unit in a mode selectable by the firearm operator.

9. The device of claim 1, wherein the heart beat cycle monitoring unit is capable of identifying each of the three stages of the heart beat cycle.

10. The device of claim 1, further comprising a heart beat cycle override unit coupled to said heart beat cycle indicating unit, wherein said heart beat cycle override unit is coupled to receive a heart beat cycle-related signal from said heart beat cycle indicating united related to the firearm operator's heart beat cycle, and the heart beat cycle override unit is capable of preventing manual operation of the firearm by a firearm operator during one or more specified periods of the firearm operator's heart beat cycle.

11. The device of claim 10, further comprising a trigger deactivation unit coupled to the heart beat cycle override unit and to a trigger of the firearm.

12. The device of claim 1, further comprising an automatic firing assembly capable of firing the firearm at the appropriate point in time during the heart beat cycle.

13. The device of claim 1, wherein the heart beat cycle indicating unit determines and signals the appropriate point in time based on a reaction time of the firearm operator and said heat beat cycle.

14. The device of claim 1, wherein the heart beat cycle indicating unit determines and signals the appropriate point in time based on a physiological state of the firearm operator.

15. The device of claim 1, wherein the heart beat cycle indicating unit generates an output signal to communicate to the firearm operator the appropriate point in time during the heart beat cycle for the firearm operator to fire the firearm.

16. The device of claim 15, further comprising a display unit responsive to the output signal from the heart beat cycle indicating unit to display an image indicating the point in time when the firearm operator should fire the firearm.

17. The device of claim 16, wherein the display unit can be attached to a sighting device of the firearm.

18. The device of claim 16, wherein the image displayed by the display begins at a point in time before the point in time when the firearm operator to fire a firearm, and changes in time until the point in time for the firearm operator to fire the firearm.

19. The device of claim 18, wherein one of size and brightness of the image displayed increases such that the image achieves a maximum size or brightness at the appropriate point in time for the firearm operator to fire the firearm.

20. The device of claim 15, further comprising an audio unit responsive to the output signal from the heart beat cycle indicating unit.

21. The device of claim 20, wherein the audio unit sounds a tone at the point in time when the firearm operator should fire the firearm.

22. The device of claim 21, wherein the tone begins at a point in time before the appropriate point in time for the firearm operator to fire the firearm, and changes in time until the appropriate point in time for the firearm operator to fire the firearm.

23. The device of claim 21, wherein the audio unit provides at least one warning tone prior to the point in time for the firearm operator to fire the firearm.

24. The device of claim 15, further comprising an audio unit and a visual unit responsive to the output signal from the heart beat cycle indicating unit to inform the firearm operator of the point in time for the firearm operator to fire the firearm, wherein the firearm operator can selectively enable each of the audio and visual unit.

25. The device of claim 1, wherein the heart beat cycle monitoring unit comprises at least one electrode capable of contact with the firearm operator's body.

26. The device of claim 25, wherein the electrode is conformed to attach to one of the ear and the wrist of the firearm operator's body.

27. The device of claim 1, wherein the heart beat cycle indicating unit further comprises a pulse oximeter.

28. The device of claim 1, wherein the heart beat cycle monitoring unit comprises an EKG device.

29. The heart beat cycle indicating device of claim 1, further comprising a pulse monitoring device to monitor a pulse of an individual.

30. The device of claim 1, further comprising a sighting device for a firearm, wherein said heart beat cycle indicating unit is coupled to said sighting device, and said heart beat cycle indicating unit is capable of providing an image visible within said sighting device at prescribed times during the heart beat cycle of the operator.

31. A firearm in combination with a heart beat cycle indicating device, comprising:

a firearm including a sighting device;

a heart beat cycle indicating unit coupled to said sighting device; and a heart beat cycle monitoring unit coupled to said heart beat cycle indicating unit.

32. The firearm combination of claim 31, further comprising:

an automatic firing assembly, said automatic firing assembly comprising a target detection unit to detect a suitable target; and a trigger actuation unit coupled to said target detection unit, said trigger actuation unit further coupled to a trigger, said trigger actuation unit to actuate said trigger and to fire said firearm upon receiving a signal from said automatic firing assembly.

33. The firearm combination of claim 14, wherein said heart beat cycle monitoring unit is conductively coupled to a firearm operator.

34. The method of configuring a firearm with both a heart beat cycle indicating device and an automatic firing assembly, comprising the steps of:

a) providing a firearm including a trigger;

b) providing a heart beat cycle indicating device having a heart beat cycle indicating unit;

c) providing an automatic firing assembly having a trigger actuation unit;

d) coupling the heart beat cycle indicating device to the firearm; and e) coupling the automatic firing assembly to the firearm.

35. The method of claim 34, wherein said step d) comprises coupling the heart beat cycle indicating unit to a sighting device of the firearm.

36. The method of claim 34, wherein a mode of firing the firearm is selectable by the operator.

37. The method of claim 34, wherein said step e) comprises coupling the trigger actuation unit to the trigger of the firearm.

* * * * *